US009520018B2

(12) United States Patent
Brunell et al.

(10) Patent No.: US 9,520,018 B2
(45) **Date of Patent: *Dec. 13, 2016**

(54) CONTROLLING PRIORITY OF WAGERING GAME LIGHTING CONTENT

(71) Applicant: Bally Gaming, Inc., Las Vegas, NV (US)

(72) Inventors: Edward G. Brunell, Chicago, IL (US); Jacob C. Greenberg, Elgin, IL (US); Timothy T. Gronkowski, Chicago, IL (US); John Michael Holmes, Chicago, IL (US); Timothy C. Loose, Chicago, IL (US); Paul J. Radek, Naperville, IL (US); Martin R. Ugarte, Jr., Chicago, IL (US); Muthu Velu, Schaumburg, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 44 days.

This patent is subject to a terminal disclaimer.

(21) Appl. No.: 14/614,089

(22) Filed: Feb. 4, 2015

(65) Prior Publication Data

US 2015/0148134 A1 May 28, 2015

Related U.S. Application Data

(63) Continuation of application No. 13/382,738, filed as application No. PCT/US2010/041112 on Jul. 6, 2010, now Pat. No. 8,968,088.

(Continued)

(51) Int. Cl.
*A63F 9/24* (2006.01)
*G07F 17/32* (2006.01)

(Continued)

(52) U.S. Cl.
CPC ..... *G07F 17/3213* (2013.01); *G07F 9/023* (2013.01); *G07F 17/3216* (2013.01);

(Continued)

(58) Field of Classification Search
CPC ..... H05B 37/029; H05B 37/0254; F21W 2131/406; G07F 17/3209; G07F 17/3223; G07F 17/3225; G07F 17/3213; G07F 17/3216; G07F 17/3227; H04N 9/3147; H04N 9/3182; G09G 2320/0693; G09G 3/002

See application file for complete search history.

(56) References Cited

U.S. PATENT DOCUMENTS 5,259,613 A 11/1993 Marnell, II
5,483,631 A 1/1996 Nagai et al.

(Continued)

FOREIGN PATENT DOCUMENTS

EP 1439507 7/2004
WO 2004086320 10/2001

(Continued)

OTHER PUBLICATIONS

"Coyote Moon", IGT, 2005, 2 pages.

(Continued)

*Primary Examiner* — Justin Myhr
(74) *Attorney, Agent, or Firm* — DeLizio Law, PLLC

(57) ABSTRACT

A wagering game system and its operations which can include analyzing electronic information associated with a first gaming effect and a second gaming effect provided for concurrent presentation via an output device, determining that the first gaming effect has a higher priority than the second gaming effect, and causing the first gaming effect to be presented via the output device before the second gaming effect is presented based on the higher priority. The opera- (Continued)

tions can further include preventing, without user input, presentation of a first portion of the second amine effect via the output device while the first gaming effect is presented. The operations can further include electronically determining that a second portion of the second gaming effect is available for presentation after an ending point for the first gaming effect, and causing the second portion to be presented via the output device after the first gaming effect.

24 Claims, 13 Drawing Sheets

Related U.S. Application Data

(60) Provisional application No. 61/261,306, filed on Nov. 14, 2009, provisional application No. 61/223,569, filed on Jul. 7, 2009.

(51) Int. Cl.

| | |
|---|---|
| ***H05B 37/02*** | (2006.01) |
| ***G07F 9/02*** | (2006.01) |
| ***H05B 41/44*** | (2006.01) |
| ***G07F 17/34*** | (2006.01) |

(52) U.S. Cl.

CPC ..... *G07F 17/3227* (2013.01); *G07F 17/34* (2013.01); *H05B 37/029* (2013.01); *H05B 37/0254* (2013.01); *H05B 41/44* (2013.01)

(56) References Cited

U.S. PATENT DOCUMENTS

| | | | |
|---|---|---|---|
| 5,633,933 | A | 5/1997 | Aziz |
| 6,040,831 | A | 3/2000 | Nishida |
| 6,081,266 | A | 6/2000 | Sciammaella |
| 6,146,273 | A | 11/2000 | Olsen |
| 6,217,448 | B1 | 4/2001 | Olsen |
| 6,339,796 | B1 | 1/2002 | Gambino |
| 6,647,119 | B1 | 11/2003 | Slezak |
| 6,843,723 | B2 | 1/2005 | Joshi |
| 6,927,545 | B2 | 8/2005 | Belliveau |
| 6,939,226 | B1 | 9/2005 | Joshi |
| 6,960,136 | B2 | 11/2005 | Joshi et al. |
| 6,972,528 | B2 | 12/2005 | Shao et al. |
| 6,974,385 | B2 | 12/2005 | Joshi et al. |
| 6,991,543 | B2 | 1/2006 | Joshi |
| 6,997,803 | B2 | 2/2006 | LeMay et al. |
| 7,082,572 | B2 | 7/2006 | Pea et al. |
| 7,112,139 | B2 | 9/2006 | Paz Barahona et al. |
| 7,181,370 | B2 | 2/2007 | Furem et al. |
| 7,228,190 | B2 | 6/2007 | Dowling et al. |
| 7,269,648 | B1 | 9/2007 | Krishnan et al. |
| 7,364,508 | B2 | 4/2008 | Loose et al. |
| 7,367,886 | B2 | 5/2008 | Loose et al. |
| 7,449,839 | B1 | 11/2008 | Chen et al. |
| 7,479,063 | B2 | 1/2009 | Pryzby et al. |
| 7,495,671 | B2 | 2/2009 | Chemel et al. |
| 7,550,931 | B2 | 6/2009 | Lys et al. |
| 7,666,091 | B2 | 2/2010 | Joshi et al. |
| 7,682,249 | B2 | 3/2010 | Winans et al. |
| 7,811,170 | B2 | 10/2010 | Winans et al. |
| 7,867,085 | B2 | 1/2011 | Pryzby et al. |
| 7,972,214 | B2 | 7/2011 | Kinsley et al. |
| 8,079,902 | B2 | 12/2011 | Michaelson et al. |
| 8,083,587 | B2 | 12/2011 | Okada |
| 8,591,315 | B2 | 11/2013 | Gagner et al. |
| 8,613,667 | B2 | 12/2013 | Brunell et al. |
| 8,622,830 | B2 | 1/2014 | Radek et al. |
| 8,814,673 | B1 | 8/2014 | Brunell et al. |
| 8,827,805 | B1 | 9/2014 | Caporusso et al. |
| 8,840,464 | B1 | 9/2014 | Brunell et al. |
| 8,968,088 | B2 | 3/2015 | Brunell et al. |
| 9,011,247 | B2 | 4/2015 | Gronkowski et al. |
| 9,087,429 | B2 | 7/2015 | Brunell et al. |
| 2001/0021666 | A1 | 9/2001 | Yoshida et al. |
| 2002/0010018 | A1 | 1/2002 | Lemay et al. |
| 2002/0055978 | A1 | 5/2002 | Joon-Boo et al. |
| 2002/0160826 | A1 | 10/2002 | Gomez et al. |
| 2003/0002246 | A1 | 1/2003 | Kerr |
| 2003/0007648 | A1 | 1/2003 | Currell |
| 2003/0017865 | A1 | 1/2003 | Beaulieu et al. |
| 2003/0130033 | A1 | 7/2003 | Loose |
| 2003/0132722 | A1 | 7/2003 | Chansky et al. |
| 2004/0072610 | A1 | 4/2004 | White et al. |
| 2004/0142747 | A1 | 7/2004 | Pryzby |
| 2004/0160199 | A1 | 8/2004 | Morgan et al. |
| 2004/0178750 | A1 | 9/2004 | Belliveau |
| 2004/0209692 | A1 | 10/2004 | Schober et al. |
| 2005/0043090 | A1 | 2/2005 | Pryzby et al. |
| 2005/0044500 | A1 | 2/2005 | Orimoto et al. |
| 2005/0054440 | A1 | 3/2005 | Anderson et al. |
| 2005/0077843 | A1 | 4/2005 | Benditt |
| 2005/0116667 | A1 | 6/2005 | Mueller et al. |
| 2005/0128751 | A1 | 6/2005 | Roberge et al. |
| 2005/0153780 | A1 | 7/2005 | Gauselmann |
| 2005/0164785 | A1 | 7/2005 | Connelly |
| 2005/0164786 | A1 | 7/2005 | Connelly |
| 2005/0164787 | A1 | 7/2005 | Connelly |
| 2005/0164788 | A1 | 7/2005 | Grabiec |
| 2005/0174473 | A1 | 8/2005 | Morgan et al. |
| 2005/0200318 | A1 | 9/2005 | Hunt et al. |
| 2005/0239545 | A1 | 10/2005 | Rowe |
| 2005/0248299 | A1 | 11/2005 | Chemel et al. |
| 2005/0275626 | A1 | 12/2005 | Mueller et al. |
| 2005/0277469 | A1 | 12/2005 | Pryzby et al. |
| 2005/0282631 | A1 | 12/2005 | Bonney et al. |
| 2006/0009285 | A1 | 1/2006 | Pryzby et al. |
| 2006/0022214 | A1 | 2/2006 | Morgan et al. |
| 2006/0025211 | A1 | 2/2006 | Wilday et al. |
| 2006/0046829 | A1 | 3/2006 | White |
| 2006/0076908 | A1 | 4/2006 | Morgan et al. |
| 2006/0244622 | A1 | 11/2006 | Wray |
| 2006/0253781 | A1 | 11/2006 | Pea et al. |
| 2007/0004510 | A1 | 1/2007 | Underdahl et al. |
| 2007/0008711 | A1 | 1/2007 | Kim |
| 2007/0032288 | A1 | 2/2007 | Nelson et al. |
| 2007/0036368 | A1 | 2/2007 | Hettinger et al. |
| 2007/0086754 | A1 | 4/2007 | Lys et al. |
| 2007/0111776 | A1 | 5/2007 | Griswold et al. |
| 2007/0189026 | A1 | 8/2007 | Chemel et al. |
| 2007/0218970 | A1 | 9/2007 | Patel et al. |
| 2007/0218974 | A1 | 9/2007 | Patel et al. |
| 2007/0219000 | A1 | 9/2007 | Aida |
| 2007/0291483 | A1 | 12/2007 | Lys |
| 2007/0293304 | A1 | 12/2007 | Loose et al. |
| 2008/0039213 | A1 | 2/2008 | Cornell et al. |
| 2008/0070685 | A1 | 3/2008 | Pryzby et al. |
| 2008/0094005 | A1 | 4/2008 | Rabiner et al. |
| 2008/0113715 | A1 | 5/2008 | Beadell et al. |
| 2008/0113796 | A1 | 5/2008 | Beadell et al. |
| 2008/0113821 | A1 | 5/2008 | Beadell et al. |
| 2008/0143267 | A1 | 6/2008 | Neuman |
| 2008/0161108 | A1 | 7/2008 | Dahl et al. |
| 2008/0176647 | A1 | 7/2008 | Acres |
| 2008/0231203 | A1 | 9/2008 | Budde et al. |
| 2008/0274793 | A1 | 11/2008 | Selig et al. |
| 2008/0278946 | A1 | 11/2008 | Tarter et al. |
| 2008/0288607 | A1 | 11/2008 | Muchow |
| 2008/0309259 | A1 | 12/2008 | Snijder et al. |
| 2009/0009997 | A1 | 1/2009 | Sanfilippo et al. |
| 2009/0023485 | A1 | 1/2009 | Ishihata et al. |
| 2009/0149242 | A1 | 6/2009 | Woodard et al. |
| 2009/0170597 | A1 | 7/2009 | Bone et al. |
| 2009/0197673 | A1 | 8/2009 | Bone et al. |
| 2009/0203427 | A1 | 8/2009 | Okada |
| 2009/0206773 | A1 | 8/2009 | Chang |
| 2009/0270167 | A1 | 10/2009 | Ajiro et al. |
| 2009/0298579 | A1 | 12/2009 | Radek et al. |
| 2009/0318223 | A1 | 12/2009 | Langridge et al. |
| 2010/0022298 | A1 | 1/2010 | Kukita |
| 2010/0022305 | A1 | 1/2010 | Yano |

(56) References Cited

U.S. PATENT DOCUMENTS

| | | | |
|---|---|---|---|
| 2010/0029385 | A1 | 2/2010 | Garvey et al. |
| 2010/0031186 | A1 | 2/2010 | Tseng et al. |
| 2010/0075750 | A1 | 3/2010 | Bleich et al. |
| 2010/0113136 | A1 | 5/2010 | Joshi et al. |
| 2010/0171145 | A1 | 7/2010 | Morgan et al. |
| 2010/0213876 | A1 | 8/2010 | Adamson et al. |
| 2010/0234107 | A1 | 9/2010 | Fujimoto et al. |
| 2010/0277079 | A1 | 11/2010 | Van Der et al. |
| 2010/0309016 | A1 | 12/2010 | Wendt et al. |
| 2010/0317437 | A1 | 12/2010 | Berry et al. |
| 2011/0035404 | A1 | 2/2011 | Morgan et al. |
| 2011/0045905 | A1 | 2/2011 | Radek |
| 2011/0050101 | A1 | 3/2011 | Bailey et al. |
| 2011/0070948 | A1 | 3/2011 | Bainbridge et al. |
| 2011/0118018 | A1 | 5/2011 | Toyoda |
| 2011/0118034 | A1 | 5/2011 | Jaffe et al. |
| 2011/0190052 | A1 | 8/2011 | Takeda et al. |
| 2012/0009995 | A1 | 1/2012 | Osgood |
| 2012/0040738 | A1 | 2/2012 | Lanning et al. |
| 2012/0115608 | A1 | 5/2012 | Pfeifer et al. |
| 2012/0122571 | A1 | 5/2012 | Desimone et al. |
| 2012/0129601 | A1 | 5/2012 | Gronkowski et al. |
| 2012/0178523 | A1 | 7/2012 | Greenberg et al. |
| 2012/0178528 | A1 | 7/2012 | Brunell et al. |
| 2013/0005458 | A1 | 1/2013 | Kosta et al. |
| 2013/0184078 | A1 | 7/2013 | Brunell et al. |
| 2013/0310178 | A1 | 11/2013 | Pryzby et al. |
| 2014/0073430 | A1 | 3/2014 | Brunell et al. |
| 2014/0228121 | A1 | 8/2014 | Berry et al. |
| 2014/0228122 | A1 | 8/2014 | Berry et al. |
| 2014/0335956 | A1 | 11/2014 | Brunell et al. |
| 2014/0378225 | A1 | 12/2014 | Caporusso et al. |

FOREIGN PATENT DOCUMENTS

| | | |
|---|---|---|
| WO | 2004014501 | 2/2004 |
| WO | 2004075128 | 9/2004 |
| WO | 2004075129 | 9/2004 |
| WO | WO2004075128 | 9/2004 |
| WO | 2005113089 | 12/2005 |
| WO | 2005114598 | 12/2005 |
| WO | 2005114599 | 12/2005 |
| WO | 2005117647 | 12/2005 |
| WO | 2006017444 | 2/2006 |
| WO | 2006017445 | 2/2006 |
| WO | 2006033941 | 3/2006 |
| WO | 2006039284 | 4/2006 |
| WO | 2006039323 | 4/2006 |
| WO | 2006125013 | 11/2006 |
| WO | 2007022294 | 2/2007 |
| WO | 2007022343 | 2/2007 |
| WO | 2007061904 | 5/2007 |
| WO | 2007133566 | 11/2007 |
| WO | 2008057538 | 5/2008 |
| WO | 2008063391 | 5/2008 |
| WO | 2008137130 | 11/2008 |
| WO | 2009054930 | 4/2009 |
| WO | 2010048068 | 4/2010 |
| WO | 2011005797 | 1/2011 |
| WO | 2011005798 | 1/2011 |
| WO | 2011014760 | 2/2011 |
| ZA | 20041110 | 8/2005 |

OTHER PUBLICATIONS

"Elvis Little More Action", 24Hr-Slots, Sep. 5, 2009, 4 pages.
"PCT Application No. PCT/US10/41111 International Preliminary Report on Patentability", Oct. 24, 2011, 13 pages.
"PCT Application No. PCT/US10/41111 International Search Report", Sep. 1, 2010, 12 pages.
"PCT Application No. PCT/US10/41112 International Preliminary Report on Patentability", Aug. 31, 2012, 4 pages.
"PCT Application No. PCT/US10/41112 International Search Report", Sep. 2, 2010, 11 pages.
"PCT Application No. PCT/US10/43886 International Preliminary Report on Patentability", May 3, 2012, 4 pages.
"PCT Application No. PCT/US10/43886 International Search Report", Sep. 16, 2010, 12 pages.
"U.S. Appl. No. 12/797,756 Office Action", Nov. 7, 2013, 7 Pages.
"U.S. Appl. No. 12/860,467 Office Action", Jan. 17, 2013, 16 pages.
"U.S. Appl. No. 12/965,749 Final Office Action", Dec. 15, 2014, 32 Pages.
"U.S. Appl. No. 12/965,749 Final Office Action", Apr. 22, 2013, 30 pages.
"U.S. Appl. No. 12/965,749 Final Office Action", Apr. 30, 2014, 40 Pages.
"U.S. Appl. No. 12/965,749 Office Action", Nov. 8, 2012, 30 pages.
"U.S. Appl. No. 12/965,749 Office Action", Dec. 17, 2013, 35 Pages.
"U.S. Appl. No. 12/965,749 Office Action", Sep. 4, 2014, 33 Pages.
"U.S. Appl. No. 12/971,544 Final Office Action", Mar. 14, 2013, 38 pages.
"U.S. Appl. No. 12/971,544 Office Action", Nov. 6, 2012, 43 pages.
"U.S. Appl. No. 13/094,560 Final Office Action", May 23, 2014, 9 Pages.
"U.S. Appl. No. 13/094,560 Office Action", Mar. 30, 2012, 13 pages.
"U.S. Appl. No. 13/094,560 Office Action", Dec. 6, 2013, 9 Pages.
"U.S. Appl. No. 13/094,701 Final Office Action", Nov. 28, 2012, 14 pages.
"U.S. Appl. No. 13/094,701 Office Action", Mar. 27, 2012, 26 pages.
"U.S. Appl. No. 13/094,811 Final Office Action", Dec. 24, 2013, 15 Pages.
"U.S. Appl. No. 13/094,811 Office Action", Apr. 3, 2012, 16 pages.
"U.S. Appl. No. 13/094,811 Office Action", Jun. 21, 2013, 19 pages.
"U.S. Appl. No. 13/204,225 Final Office Action", Sep. 25, 2013, 16 PAges.
"U.S. Appl. No. 13/204,225 Office Action", Jun. 22, 2012, 23 pages.
"U.S. Appl. No. 13/204,225 Office Action", Feb. 27, 2013, 19 pages.
"U.S. Appl. No. 13/382,738 Final Office Action", Mar. 12, 2014, 23 Pages.
"U.S. Appl. No. 13/382,738 Final Office Action", Jul. 8, 2014, 20 Pages.
"U.S. Appl. No. 13/382,738 Office Action", Feb. 7, 2013, 41 pages.
"U.S. Appl. No. 13/382,738 Office Action", Sep. 24, 2013, 24 Pages.
"U.S. Appl. No. 13/382,783 Office Action", Feb. 28, 2013, 26 pages.
"U.S. Appl. No. 13/382,783 Final Office Action", Oct. 4, 2013, 22 Pages.
"U.S. Appl. No. 13/382,783 Office Action", Apr. 16, 2014, 24 Pages.
"U.S. Appl. No. 13/382,783 Office Action", Jul. 25, 2013, 20 Pages.
"U.S. Appl. No. 13/382,783 Office Action", Sep. 24, 2014, 5 Pages.
"U.S. Appl. No. 13/388,118 Final Office Action", May 23, 2014, 11 Pages.
"U.S. Appl. No. 13/388,118 Office Action", Oct. 11, 2013, 9 Pages.
"U.S. Appl. No. 14/080,272 Office Action", Oct. 23, 2014, 5 Pages.
Gusella, et al., "An Election Algorithm for a Distributed Clock Synchronization Program", Berkley, Dec. 1985, 19 pages.
NYPHINIX13, "Star Wars Cloud City Slot Bonus—IGT", YouTube, Mar. 18, 2010, 1 page.
Co-pending U.S. Appl. No. 12/965,749, filed Dec. 10, 2010, 48 Pages.
Co-pending U.S. Appl. No. 12/971,544, filed Dec. 17, 2010, 46 Pages.
Co-pending U.S. Appl. No. 12/860,467, filed Aug. 20, 2010, 49 Pages.
Co-pending U.S. Appl. No. 12/797,756, filed Jun. 10, 2010, 63 Pages.
Co-pending U.S. Appl. No. 14/080,272, filed Nov. 14, 2013, 39 Pages.
Co-pending U.S. Appl. No. 13/109,427, filed May 17, 2011, 45 Pages.
Co-pending U.S. Appl. No. 13/094,560, filed Apr. 26, 2011, 30 Pages.
Co-pending U.S. Appl. No. 13/094,701, filed Apr. 26, 2011, 40 Pages.

(56) References Cited

OTHER PUBLICATIONS

Co-pending U.S. Appl. No. 14/446,081, filed Jul. 29, 2014, 40 Pages.
Co-pending U.S. Appl. No. 13/204,225, filed Aug. 5, 2011, 45 Pages.
Co-pending U.S. Appl. No. 14/480,397, filed Sep. 8, 2014, 39 Pages.
Co-pending U.S. Appl. No. 13/094,811, filed Apr. 26, 2011, 31 Pages.
Co-pending U.S. Appl. No. 14/254,656, filed Apr. 16, 2014, 31 Pages.
"U.S. Appl. No. 12/965,749 Office Action", Mar. 18, 2015, 28 Pages.
"U.S. Appl. No. 13/382,783 Final Office Action", Feb. 20, 2015, 10 Pages.
Co-pending U.S. Appl. No. 14/677,660, filed Apr. 2, 2015, 46 pages.

| SHOW # | FRAME # | EMOTIVE LIGHT | COLOR | EFFECT |
|---|---|---|---|---|
| 225 | 7 | 197 | BLUE | SOLID |
| ⋮ | ⋮ | ⋮ | ⋮ | ⋮ |
| **131** | **16** | **197** | **RED** | **SOLID** |
| ⋮ | ⋮ | ⋮ | ⋮ | ⋮ |
| 76 | 76 | 197 | BLACK | OFF |
| ⋮ | ⋮ | ⋮ | ⋮ | ⋮ |
| 17 | 8 | 197 | WHITE | BLINK |

510

| COMMAND SOURCE | TIMING | P# | RESULT |
|---|---|---|---|
| BANK SHOW CONTROLLER | RAINBOW EFFECT FOR 25 FRAMES | 21 | **ACTIVATE RAINBOW EFFECT FOR 25 FRAMES IN SYNC PATTERN** |
| CASINO NETWORK EMOTIVE LIGHT CONTROLLER | CHASE EFFECT FOR AS LONG AS TRANSMITTED | 17 | IGNORE FOR 25 FRAMES THEN ACTIVATE IF HIGHEST PRIORITY AT THAT TIME |

810

| COMMAND SOURCE | LIGHTING EFFECT | TIMING | P# | T# | EMOTIVE LIGHT CONTROL INSTRUCTIONS |
|---|---|---|---|---|---|
| GAME APP | WIN EFFECT | 5 SECONDS | 150 | 128 | DISPLAY WIN EFFECT, DURATION OF 5 SECONDS, LAYER 2 (HIGHEST), TRANSPARENCY 75 |
| BANK SHOW CONTROLLER | RAINBOW EFFECT | 15 SECONDS | 80 | 0 | DISPLAY RAINBOW EFFECT DURATION OF 15 SECONDS, LAYER 1 (LOWEST), TRANSPARENCY 0 |
| CASINO NETWORK EMOTIVE LIGHT CONTROLLER | CHASE EFFECT | AS LONG AS TRANSMITTED | 50 | 64 | DO NOT DISPLAY CHASE EFFECT UNTIL SHOW WITH NEXT HIGHEST PRIORITY ALLOWS FOR TRANSPARENCY |

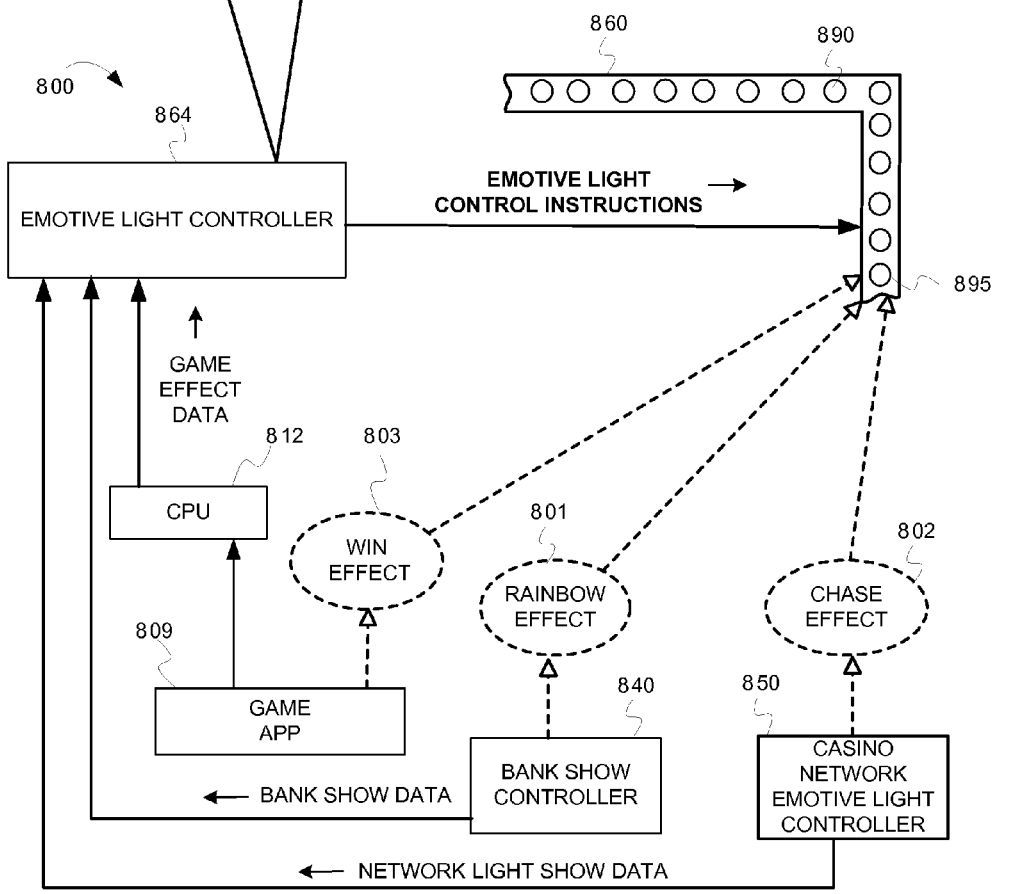

FIG. 8

910

| COMMAND SOURCE | CURRENT EFECT/ COLOR | TIMING | P# | T# | EMOTIVE LIGHT CONTROL INSTRUCTIONS |
|---|---|---|---|---|---|
| GAME APP | WIN EFFECT | 5 SECONDS | 150 | 128 | ACTIVATE WIN EFFECT, DURATION OF 5 SECONDS, NO LAYERING NO TRANSPARENCY DUE TO RULES RESTRICTION |
| BANK SHOW CONTROLLER | RAINBOW EFFECT | 15 SECONDS | 80 | 0 | DO NOT DISPLAY RAINBOW EFFECT UNTIL WIN EFFECT IS COMPLETED |
| CASINO NETWORK EMOTIVE LIGHT CONTROLLER | CHASE EFFECT | AS LONG AS TRANSMITTED | 50 | 64 | DO NOT DISPLAY CHASE EFFECT UNTIL WIN EFFECT IS COMPLETED |

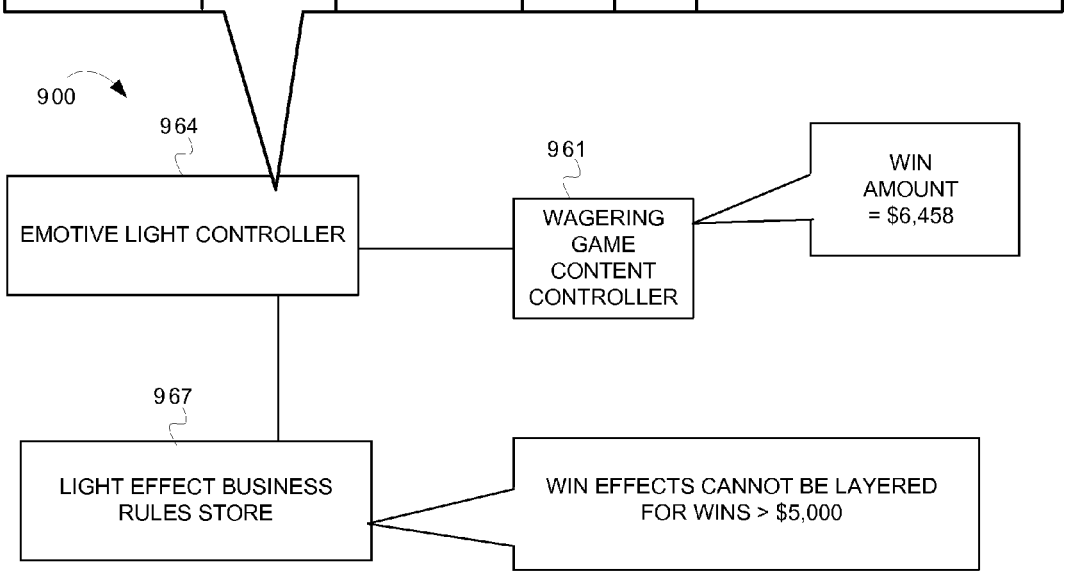

FIG. 9

CONTROLLING PRIORITY OF WAGERING GAME LIGHTING CONTENT

RELATED APPLICATIONS

This application is a continuation application of U.S. application Ser. No. 13/382,738, which is a National Stage Application of PCT/US10/41112 filed 6 Jul. 2010, which claims the priority benefit of U.S. Provisional Application Ser. No. 61/223,569 filed Jul. 7, 2009 and U.S. Provisional Application No. 61/261,306 filed Nov. 14, 2009. The Ser. No. 13/382,738 Application, the PCT/US10/41112 Application, the 61/223,569 Application, and the No. 61/261,306 Application are incorporated herein by reference.

LIMITED COPYRIGHT WAIVER

A portion of the disclosure of this patent document contains material, which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

TECHNICAL FIELD

Embodiments of the inventive subject matter relate generally to wagering game systems and networks that, more particularly, control wagering game lighting content.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

A gaming system that can perform operations to analyze, prioritize, and present different gaming effects competing for presentation on the same output device. For instance, the gaming system analyzes electronic information received via a network communication interface. The electronic information is associated with a first gaming effect and a second gaming effect provided for concurrent presentation via the output device. The gaming system further determines, based on analysis of the electronic information, that the first gaming effect has a higher priority than the second gaming effect for presentation via the output device. Based on the first gaming effect having the higher priority, the gaming system presents the first gaming effect via the output device before presentation of the second gaming effect. Furthermore the gaming system prevents, without user input, presentation of a first portion of the second gaming effect via the output device while the first gaming effect is being presented via the output device. The gaming system further electronically determines that a second portion of the second gaming effect is available for presentation via the output device after an ending point for the first gaming effect and causes the second portion of the second gaming effect to be presented via the output device after the ending point for the first gaming effect.

BRIEF DESCRIPTION OF THE DRAWING(S)

Embodiments are illustrated in the Figures of the accompanying drawings in which:

FIG. 8 is an illustration of prioritizing casino network lighting commands using priority values and transparency values, according to some embodiments;

FIG. 9 is an illustration of prioritizing casino network lighting commands using priority values, transparency values, and light effect business rules, according to some embodiments;

DESCRIPTION OF ILLUSTRATIVE EMBODIMENTS

Figure 1A:
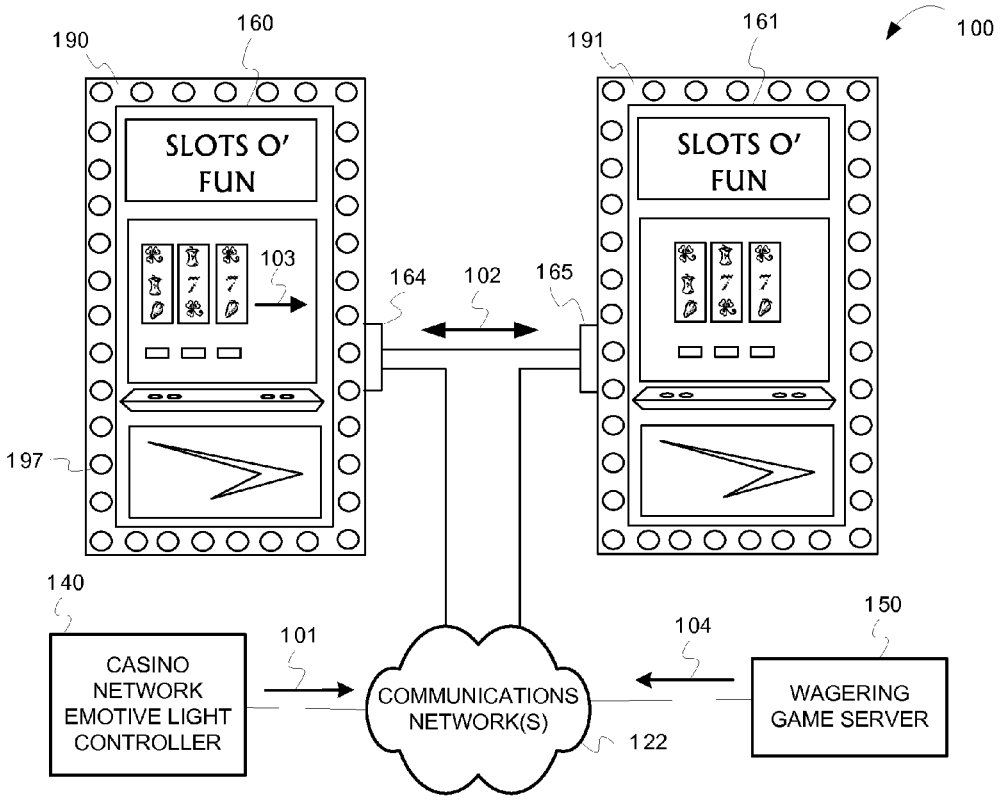
FIGS. 1A and 1B are illustrations of prioritizing multiple wagering game lighting content sources, according to some embodiments.

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

Many computerized wagering game systems (e.g., wagering game machines) have a variety of sound and graphical elements designed to attract and keep a game player's attention, such as sound effects, music, and animation. These game presentation features often include a variety of music, sound effects, and voices presented to complement a visual (e.g., video, computer animated, mechanical, etc.) presentation of the wagering game on a display. Often multiple sources of gaming content provide visual and sound content during a wagering game. Game developers face challenges controlling content from various sources. Some embodiments of the present subject matter, however, describe examples of controlling wagering game lighting content from multiple sources in a wagering game network (e.g., a casino network).

Embodiments can be presented over any type of communications network (e.g., public or private) that provides access to wagering games, such as a website (e.g., via wide-area-networks, or WANs), a private gaming network (e.g., local-area-networks, or LANs), a file sharing networks, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.). In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can be associated with the player account. Therefore, for brevity, to avoid having to describe the interconnection between player and player account in every instance, a "player account" may be referred to herein in either context. Further, in some embodiments herein, the word "gaming" is used interchangeably with "gambling".

Figure 1B:
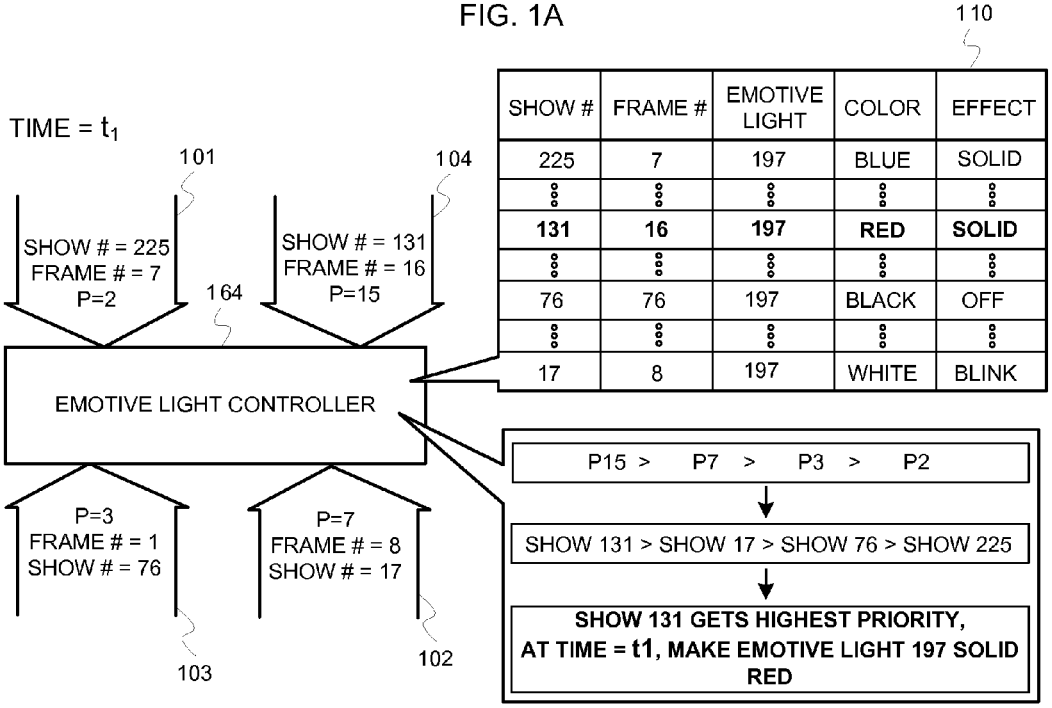

FIGS. 1A and 1B are conceptual diagrams that illustrate an example of prioritizing multiple wagering game lighting content sources, according to some embodiments. In FIG. 1A, a wagering game system ("system") 100 includes multiple wagering game machines (e.g., wagering game machines 160, 161). The wagering game machines 160, 161 are connected to a communications network 122. Also connected to the communications network 122 are a wagering game server 150 and a casino network lighting controller (e.g., a casino network emotive light controller 140). The casino network emotive light controller 140 can be connected to emotive lighting devices 190, 191 associated with (e.g., surrounding) the wagering game machines 160, 161. The casino network emotive light controller 140 can be connected to the emotive lighting devices 190, 191 via a dedicated casino-wide lighting network (e.g., included in the communications network(s) 122), such as a DMX512 lighting network, which is dedicated to communicating theatrical lighting data at very high speeds with little or no data processing to interfere with the theatrical lighting data.

The emotive lighting devices 190, 191 can include light emitting devices utilized to present lighting effects. The wagering game machines 160, 161 may be grouped together in a wagering-game-machine bank ("bank") and the wagering game machines 160, 161 can include communications devices that allow the wagering game machines 160, 161 to communicate with each other to present synchronized bank content, including bank level emotive lighting displays. For example, the wagering game machines 160, 161 can be connected via a dedicated, bank-level, peer-to-peer lighting network. The emotive lighting devices 190, 191 (and their associated wagering game machines 160, 161) can be associated with the emotive light controllers 164, 165, which can receive emotive lighting communications from several sources. For instance, in one example, the emotive light controllers 164, 165 can receive one or more of the following:

- network emotive lighting show commands ("commands 101") (e.g., from the casino network emotive light controller 140, from a DMX light controller, etc.);
- bank emotive lighting show commands ("commands 102") (e.g., from a peer-to-peer bank controller, from a bank application, etc.);
- local application emotive lighting commands ("commands 103") (e.g., from applications on the wagering game machine 160); and
- server-side application emotive lighting commands ("commands 104") (e.g., from server-side games on the wagering game server 150).

The various commands (commands 101, 102, 103 and 104) may all simultaneously compete for use of the emotive lighting devices 190, 191. For instance, each of the commands 101, 102, 103 and 104 may include instructions for an emotive light device 197 (e.g., a single light emitting diode "LED," a group of LEDs, an LED bar, etc.) to present a conflicting color, intensity level, blinking pattern, or other light presentation effect at a given time (e.g., t1).

FIG. 1B illustrates an example of emotive light presentation data included in the commands 101, 102, 103 and 104. For example, the commands 101, 102, 103, and 104 can include information that identify a light show display, including a show identification number ("show number") and a frame number for the show number at the given time, t1. The show numbers can be stored as a byte of data (e.g., an 8-bit binary unit indicating one of 256 show numbers) or other amount of data sufficient to indicate a given number of available light shows. At time t1, the commands 101 include a show number of two-hundred twenty five ("show 225") and a frame number of seven ("frame 7"), meaning that the show number presented by the casino network emotive light server 140, at time t1, is currently transmitting frame number 7 of show 255. The other commands 102, 103, and 104 also include show numbers and frame numbers, for example, the commands 102 include values of show number 17 and frame number 8, the commands 103 include values of show number 76 and frame number 1, and the commands 104 include values of show number 131 and frame number 16. The commands 101, 102, 103 and 104 also include priority data, such as priority values that indicate a numerical indicator of one show's presentation importance relative to any other show's presentation importance. The system 100 can pre-configure the priority values according to an operator's desires for priority (see FIG. 4). The system 100 can assign the priority values to the show numbers, such as illustrated (e.g., show 225 has a priority value of 2, show 17 has a priority value of 7, show 76 has a priority value of 3, and show 131 has a priority value of 15). The system 100 can scale the priority values in ascending or descending order of value. For instance, in FIG. 1B, higher priority values indicate higher priorities. Each of the emotive light controllers 164, 165, of FIGS. 1A and 1B, can be configured differently to process show numbers and frame numbers based on information such as locations of the emotive lighting devices 190, 191 or wagering game machines 160, 161 in a casino, locations of the emotive lighting devices 190, 191 or wagering game machines 160, 161 in relation to each other, player information for a player using the wagering game machines 160, 161, game information for games played on the wagering game machines 160, 161, a time of day, a maintenance schedule, or any other information that could relate to how and when to present light shows using the emotive lighting devices 190, 191.

Referring again to FIG. 1B, a configuration chart 110 includes data related to how the wagering emotive light controllers 164 controls constituent emotive lighting elements on the emotive lighting device 190, specifically, the emotive light device 197. The emotive light controller 164 receives the commands 101, 102, 103, and 104 and orders their priorities according to their priority values (e.g., show 131>show 17>show 76>show 225). Show number 131 receives the highest priority for access to the emotive light device 197 because show number 131 has the highest priority value (P15), at time t1, than any other show numbers received at the emotive lighting device 190. The emotive light controller 164 then consults the configuration chart 110 to determine a light control instruction for the emotive light device 197, for show 131 at frame 16. The configuration chart 110 indicates that the emotive light device 197 should be a solid red color. The emotive light controller 164 then causes the emotive light device 197 to be solid red at time t1. The system 100 can continuously receive updated emotive light presentation data and updated priorities to control the emotive lighting devices 190, 191.

FIGS. 1A and 1B, thus, present some embodiments of receiving emotive light presentation data from a variety of emotive light control sources, determining presentation priorities for the emotive light presentation data, and controlling the emotive light presentation data, from the variety of emotive light control sources, based on prioritization of the presentation priorities. Although FIGS. 1A and 1B describe some embodiments, the following sections describe many other features and embodiments. For example, in other embodiments, described further below, wagering game systems can control priorities based on locations of emotive lighting devices on a wagering game machine. In yet other embodiments, wagering game systems can assign priorities based on wagering game types and other classifications.

Example Operating Environments

This section describes example operating environments and networks and presents structural aspects of some embodiments. More specifically, this section includes discussion about wagering game system architectures.

Wagering Game System Architecture

Figure 2:
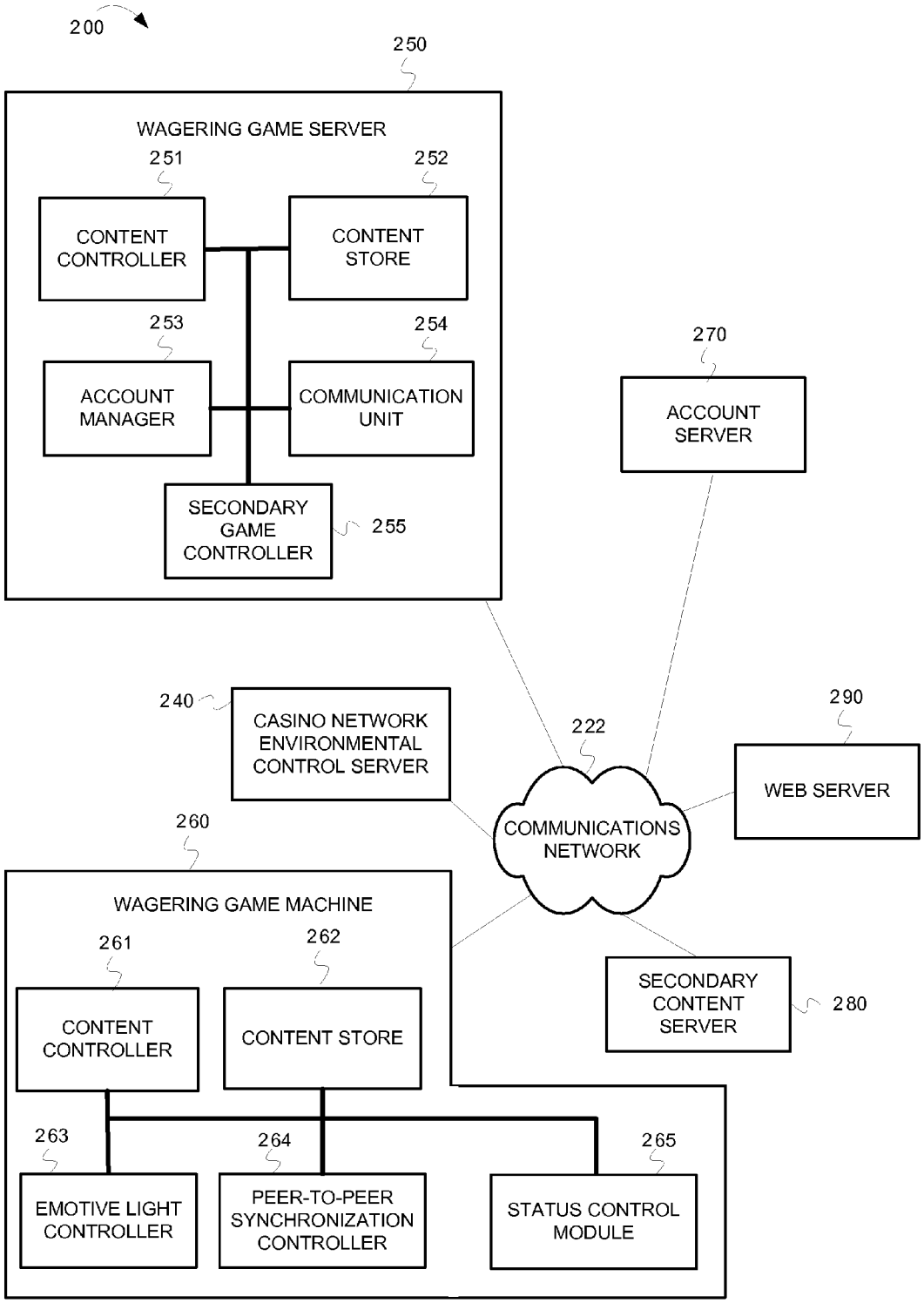
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store wagering game player account information, such as account settings, preferences, player profile data (e.g., name, avatar, etc.), and other information for a player's account (e.g., financial information, virtual assets, etc.). The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks. The wagering game server 250 can also include a secondary game controller 255 configured to control secondary game communications, content, and other information.

The wagering game system architecture 200 can also include the wagering game machine 260 configured to present wagering games and receive and transmit information to control wagering game lighting content. The wagering game machine 260 can include a content controller 261 configured to manage and control content and presentation of content on the wagering game machine 260. The wagering game machine 260 can also include a content store 262 configured to contain content to present on the wagering game machine 260. The wagering game machine 260 can also include an emotive light controller 263 configured to control communications including emotive light presentation data. In some embodiments, the emotive light controller 263 can be external to the wagering game machine 260, such as attached to a cabinet associated with the wagering game machine 260. In other embodiments, the emotive light controller 263 can be detached from the wagering game machine 260 and can be a separate device that controls emotive lighting devices assigned to, proximate to, or in other ways associated with the wagering game machine 260. The wagering game machine 260 can also include a peer-to-peer synchronization controller 264 configured to control synchronization data between wagering game machines within a machine bank including synchronization of emotive light presentation data. The wagering game machine 260 can also include a status control module 265 configured to provide presentation status information to content control sources (e.g., wagering game servers, peer-to-peer content controllers, environmental control servers, emotive light controllers, etc.). The status information can provide information about events that affect the wagering game machine 260, or other devices or components associated with the wagering game machine 260. The events can indicate that presentation devices associated with the wagering game machine 260 are inactive, unavailable, or otherwise ineligible to receive content at a given time. The status control module 265, thus, can broadcast status information to all content controllers and other sources that need to know whether the wagering game machine 260, or presentation devices associated with the wagering game machine 260, are available to participate in a synchronized content presentation (e.g., a light show, a gaming effect, etc.).

The wagering game system architecture 200 can also include a casino network environmental control server 240 configured to control environmental light and sound presentation devices within a casino. The casino network environmental control server 240 can provide emotive lighting presentation data, including light presentation commands on emotive lighting devices on or near wagering game machines, as well as other devices within the casino such as spot lights, overhead emotive lighting, projectors, etc. The casino network environmental control server 240 may include a DMX512 (DMX) light controller, an AMX192 light controller, or other networked theatrical lighting controllers, servers, devices or systems. In some embodiments, the casino network environmental control server 240 can include, control, or in other ways be associated with casino network emotive lighting controllers, such as the casino network emotive light controller 140 in FIG. 1, the casino network emotive light controller 480 in FIG. 4, and the casino network emotive light controller 550 in FIG. 5.

The wagering game system architecture 200 can also include a secondary content server 280 configured to provide content and control information for secondary games and other secondary content available on a wagering game network (e.g., secondary wagering game content, promotions content, advertising content, player tracking content, web content, etc.). The secondary content server 280 can provide "secondary" content, or content for "secondary" games presented on the wagering game machine 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. The secondary content server 280 can include one or more different servers or devices including a secondary game server (e.g., a bonus game server, etc.), a network game server (e.g., a progressive game server, a big event server), an advertising server, a community game server, etc. The secondary content server 280 can provide and control content for community games, including networked games, social games, competitive games, or any other game that multiple players can participate in at the same time.

The wagering game system architecture 200 can also include a web server 290 configured to control and present an online website that hosts wagering games. The web server 290 can also be configured to present multiple wagering game applications on the wagering game machine 260 via a wagering game website, or other gaming-type venue accessible via the Internet. The web server 290 can host an online wagering website and social network. The web server 290 can include other devices, servers, mechanisms, etc., that provide functionality (e.g., controls, web pages, applications, etc.) that web users can use to connect to a social network and/or website and utilize social network and website features (e.g., communications mechanisms, applications, etc.).

Each component shown in the wagering game system architecture 200 is shown as a separate and distinct element connected via a communications network 222. However, some functions performed by one component could be performed by other components. For example, the wagering game server 250 can also be configured to perform functions of the emotive light controller 263, the peer-to-peer synchronization controller 264, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250.

The wagering game machines described herein (e.g., wagering game machine 260) can take any suitable form, such as floor standing models, handheld mobile units, bartop models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machine (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machine can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
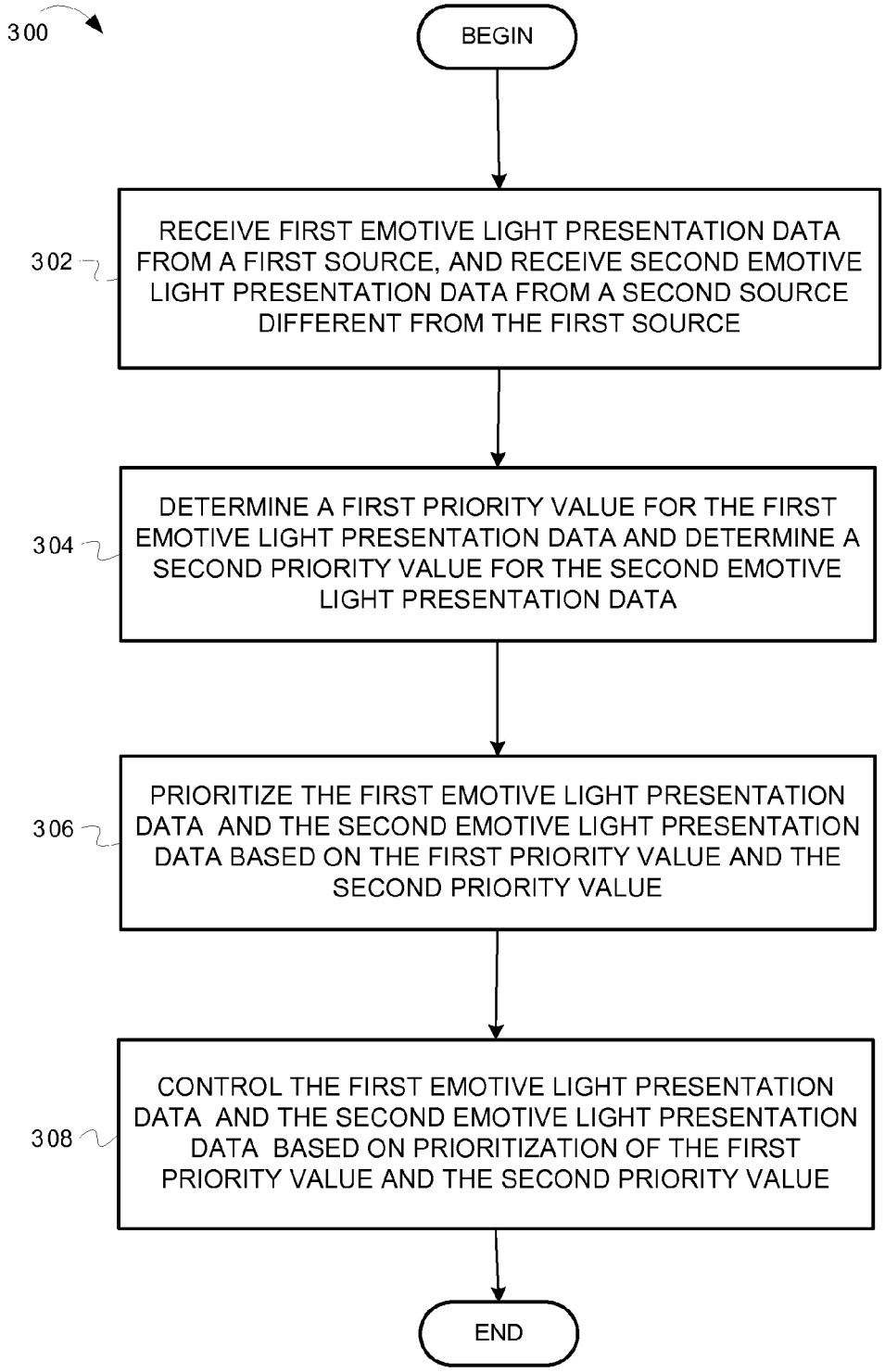
FIG. 3 is a flow diagram 300 illustrating prioritizing multiple wagering game lighting content sources, according to some embodiments.
Figure 4:
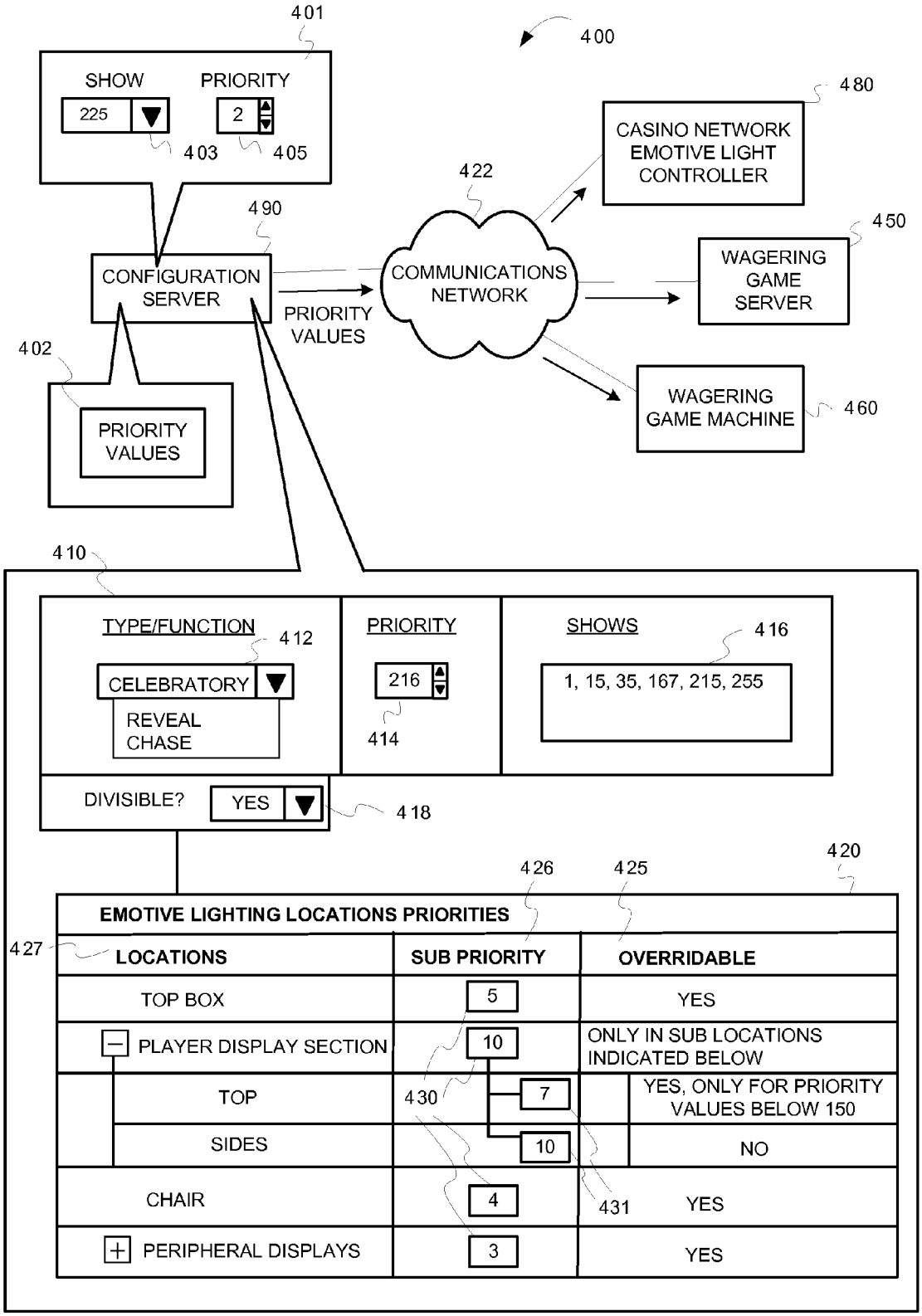
FIG. 4 is an illustration of configuring lighting priority values for wagering game types, according to some embodiments.
Figure 5:
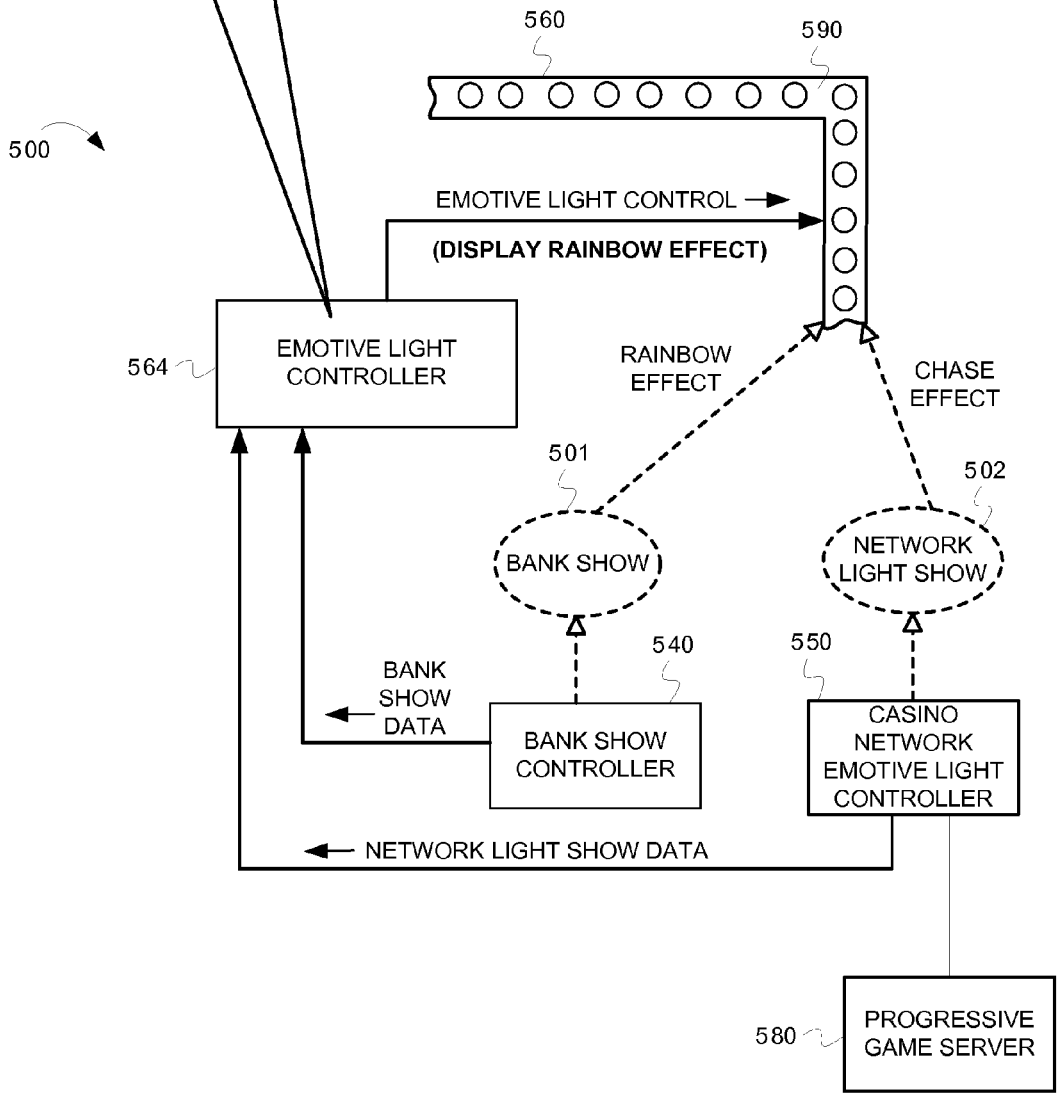
FIG. 5 is an illustration of prioritizing casino network lighting commands and peer-to-peer bank lighting commands, according to some embodiments.
Figure 6:
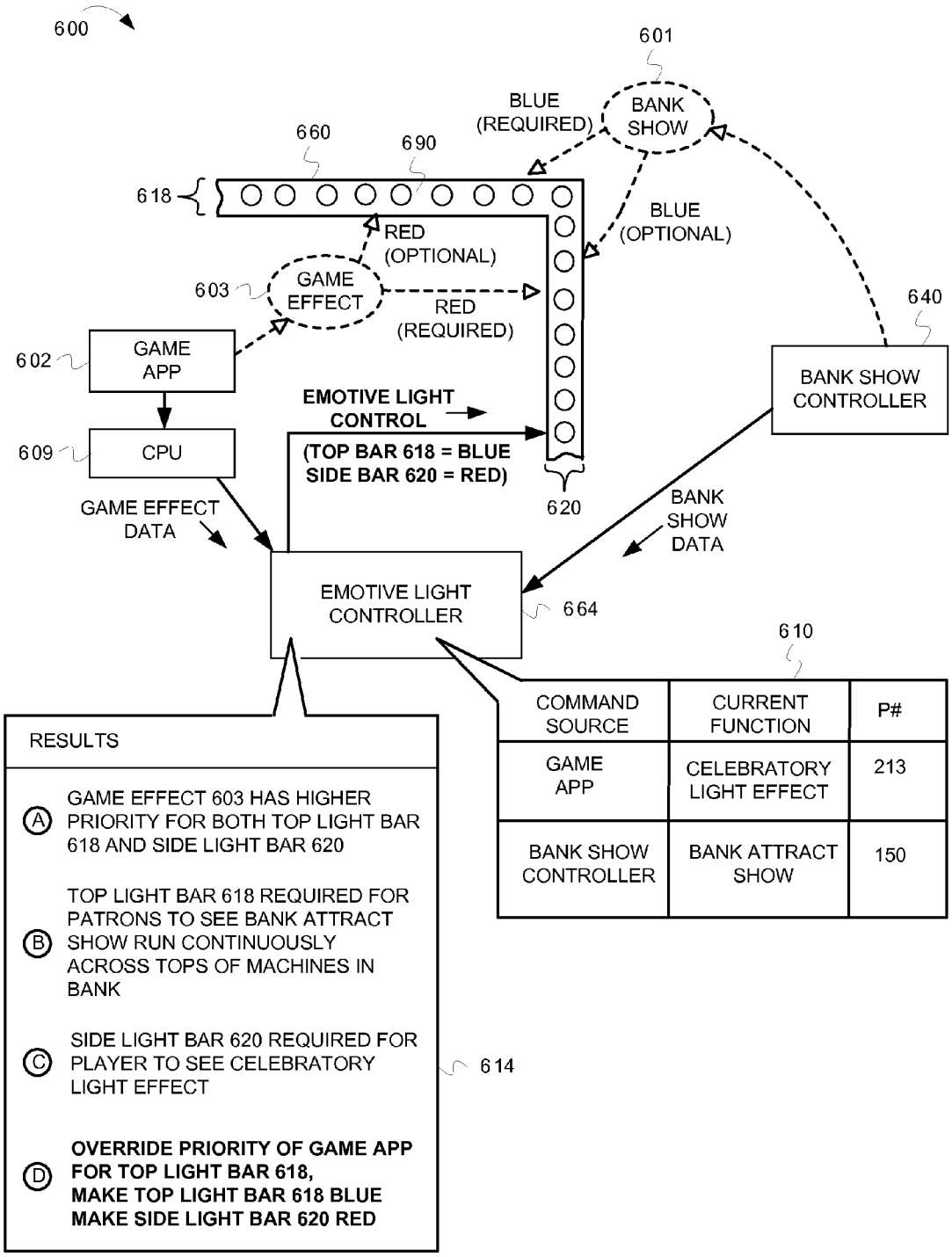
FIG. 6 is an illustration of prioritizing application lighting commands and peer-to-peer bank lighting commands, according to some embodiments.

FIG. 3 is a flow diagram ("flow") 300 illustrating prioritizing multiple wagering game lighting content sources, according to some embodiments. FIGS. 4, 5, and 6 are conceptual diagrams that help illustrate the flow of FIG. 3, according to some embodiments. This description will present FIG. 3 in concert with FIGS. 4, 5 and 6. In FIG. 3, the flow 300 begins at processing block 302, where a wagering game system ("system") receives first emotive light presentation data from a first source, and receives second emotive light presentation data from a second source different from the first source. In some embodiments, the light presentation data (from first source or second source) can include a command to direct an emotive lighting device to present light information. Light information can include color, brightness, sequences, timing, etc. related to a light show or light related presentation. The emotive lighting device can have one or more lights associated with it, including a single light, a string of lights, an orientation of lights, a light bar, a light display, a section of lights, etc. Examples of emotive lighting devices can include light emitting display (LED) bars attached to a wagering game machine cabinet, lights on a cabinet top-box, marquee lights, chair lighting, insulator lighting, reel illuminator lights, button bezels, etc. Other examples can include LED panels, spotlights, overhead lighting, etc. Thus, emotive lighting devices can include any lighting device that is used in conjunction with a light effect (e.g. a programmed light presentation, a light show, a celebratory effect, etc). The light effect may be specifically designed to evoke an emotional response in a casino patron, such as interest, excitement, etc. However, the actual lighting devices used in conjunction with a lighting effect can be any lighting device that produces viewable light that can be seen by a casino patron. Thus, some embodiments may also, or instead, refer to "light emitting" devices, "light effect" devices, "light presentation" devices, or "lighting" devices and may refer, interchangeably, to "emotive lighting" devices. Emotive lighting devices, in some embodiments, may also be networked to function in a coordinated manner to present a synchronized lighting effect or lighting presentation. In some embodiments, the system can communicate emotive lighting data between the first source and second source using different protocols and/or network types. For example, in some embodiments, the system can communicate emotive lighting data between wagering games and components of a wagering game machine (e.g., a central processing unit "CPU", an emotive light controller "ELC", and emotive lighting device, etc.) via a Universal Serial Bus (USB) connection. In some embodiments, the system can communicate emotive lighting data in a bank via a peer-to-peer communication network (e.g., Emotive Lighting Synchronization Network, or EL Sync). In some embodiments, the system can communicate emotive lighting data between network lighting controllers and wagering game machines via a DMX network. In some embodiments, exemplary sources of emotive lighting data can include (1) a wagering game on a wagering game machine, (2) a neighboring wagering game machine as part of a synchronized peer-to-peer emotive lighting network within a machine bank, (3) a casino level lighting network (e.g., DMX controller), and (4) other localized and network sources vying for use of emotive light devices on a wagering game machine such as a centralized controller or server that provides secondary wagering games. In some embodiments the secondary games can communicate directly with an emotive light controller (ELC) associated with a wagering game machine or with primary wagering games on the wagering game machine via an environmental lighting controller (e.g., DMX controller). For instance, the secondary KENO game can send an emotive lighting command to the centralized server that the KENO game is about to begin. The centralized server can send the emotive lighting command to the ELC to start a chase light show on the wagering game machine (or bank of machines). The secondary wagering game source can send the emotive lighting command directly to ELC to create the lighting effect. Thus, server side games can load their own light shows directly to a wagering game machine, through the ELC. DMX controllers can communicate directly with an ELC or group of ELCs. In some embodiments, the EL Sync can broadcast emotive lighting commands and each wagering game machine is programmed to react to the emotive lighting commands individually. On the EL Sync, one wagering game machine, or controller associated with a wagering game machine (e.g., a wagering game, an emotive light controller, etc.) can be the master controller for timing purposes during the synchronization of a coordinated bank lighting effect. A master controller for a bank ("bank controller") can send, or pass, timing to wagering games to control timing and execution of commands. Also, a DMX controller, an ELC, etc., can send or pass DMX commands to wagering games to further improve timing, parsing, processing, etc. of the DMX commands.

In some embodiments, the emotive light presentation data can control effects and/or light shows that relate to wagering game activities that occur on wagering game machines, across banks of machines, and across a casino network. Emotive light presentation data can be related to wagering game lighting effects, wagering game attract shows, betting or game results activity, celebratory effects, network game reveals, network game activity, tournament activity, game downloads, etc. In some embodiments, the emotive light presentation data can be related to wagering game effects. The following is a list of some example wagering game effects the system can activate according to some embodiments:

Light intensity effect. The system (e.g., a wagering game application, a wagering game server, a marketing server, etc.) can award a variable number of wagering game free spins or bonus picks in a bonus. The system can activate emotive lighting that lights a specified color and then increases or decreases the color intensity each time a spin or pick is made.

Color stepping effect. The system can award a variable number of wagering game free spins or bonus picks in a bonus. The system can activate emotive lighting that lights a specified color and then steps through colors each time a spin or pick is made.

Color assigning. The system can present a game with a bonus where the player can pick a character to play with. A characteristic for the character may be a certain color (e.g., the character has a yellow car) or be of a certain type (e.g., the character's car is a sports car). The system can light emotive lighting to match the color (e.g., make the emotive lighting yellow to match the car's color) or have a distinctive light presentation pattern (e.g., make the emotive lighting circle the wagering game machine fast to match the sports car's speed type). In some embodiments, the bonus game can be a community gaming events, where players on a bank of machines join in the community bonus game, each with a different character. The different characters can have different colors. The system can communicate with all the wagering game machines in the bank (e.g., via peer-to-peer communication), and light the emotive lighting on each machine to match the character's color.

Look up effect. The system presents a wagering game on a main display that awards a bonus where the player has to look up at a secondary display above the main display. The system can light emotive lights on the sides of the main display, presenting a colored light wave that pulses upward, drawing the player's eyes upward toward the secondary display.

Money accepted effect. The system can present emotive lighting with a gold and green color whenever money or a ticket-in-ticket-out (TITO) ticket is accepted into the wagering game machine's cash collector.

Cash out effect. The system presents a light show in conjunction with a cash out procedure.

Thermometer effect. The system presents a game that has a bonus or progressive that is guaranteed to go off at a certain time or amount. The system presents emotive lighting having a thermometer color index starting at cool blue and changing during active play to yellow, then to orange, and finally to red to accentuate that the game is ready to trigger a bonus or a progressive. The system can also determine that the guaranteed offering is through a side bet or max bet and present the thermometer effect accordingly.

Win line accentuating. The system can present wagering games with colored pay lines. The system can determine pay lines that have won and present emotive lighting that pulses the same color as the colors of the winning pay lines during the payout cycle. The system can pulse the colors of the winning pay lines on the emotive lighting as the system cycles a presentation the winning pay line presentation.

Win size. The system can present a colored lighting effect on the emotive lighting based on the size of a win (e.g., a jackpot win, a progressive win, etc). For example if player has a win over 30× total bet the system can present a Red-Green-Blue (RGB) color pulse effect. If, however, player has win over 100× total bet the system can present a gold color pulse effect. If a progressive game has color coding (e.g., different colors for different progressive game levels), the system can present emotive colors for wins that fall within the progressive levels.

Chase lights. In some embodiments, the system can present a "chase" light effects that include a light cluster that chases another light cluster around a wagering game machine, or around a bank of wagering game machines, for various wagering game purposes (e.g., as an attract show, as a game celebration, as specific game play elements, etc.).

In some embodiments, the emotive light presentation data can be related to bank effects. The following is a list of some example bank effects the system can activate according to some embodiments:

Hot seat effect. The system can determine wagering games, within a bank of wagering game machines, which have made an eligibility bet for a specific gaming purpose. For instance, the system can initiate a bonus gaming event for which one of many eligible machines in the bank can participate. When the bonus is initiated, the system can light emotive lighting on all eligible wagering game machines. The system can light the emotive lighting initially with a specified color, then one at a time, each eligible machine within the bank changes its emotive light to a specified secondary color to create a chase light effect across or around the bank of machines. The system controls the chase light effect to give the feel of a fast chase cycle that slows down to eventually stop on a chosen as the "hot seat," or in other words, the machine that will be awarded the bonus. The hot seat can pulse the secondary color until the bonus starts. In some embodiments, the effect can be synchronized with an animation on the base games or on wagering game machine signage. In some embodiments, different elements of the hot seat effect can be controlled by individual games running on the eligible wagering game machines.

Bank attracts. Bank "attracts" (short for attraction shows) are shows presented across a bank of machines. Bank attracts are more attractive from a distance because they use a grouping of wagering game machines to attract players to the machines in the bank. One example bank attract effect can be an attract rainbow effect. The system can generate a fading chase light effect that cycles through the Red-Green-Blue (RGB) color schemes. In some embodiments, the system can exclude the attract rainbow effect from a wagering game machine within the bank that may be ineligible for the bank attract (e.g., a wagering game machine that has credits on a game).

Span effect. The system can generate a span of lighting across a subset of adjacent wagering game machines within a bank. The adjacent wagering game machines may be grouped for cooperative play.

In some embodiments, the system can leave out, or skip, one or more content presentation devices ("presentation devices") from a bank-wide game effect because the presentation devices may be inactive, ineligible, unavailable, etc. for the bank-wide game effect (e.g., a bonus game, a reward, an attract, etc.). In some embodiments, the bank-wide game effect can be a multi-media presentation, including light, sounds, etc. The presentation devices may include wagering game machine displays, reels, emotive lighting devices, speakers, peripheral displays, etc. associated with the bank of wagering game machines. Each presentation device can have an identity (e.g., network address). The presentation devices can be configured to respond to content control data (e.g., lighting commands, sound commands, etc.) based on various factors (e.g., types of content presentation devices in a bank, current states of content presentation devices, etc.). The system can utilize the unique addresses to send different content control data, or no content control data, to inactive or ineligible presentation devices so that the content presentation devices are skipped, or left out, of the bank-wide game effect. Even though the system can leave a content presentation device out of a bank-wide game effect, the system can still monitor gaming activity and continuously evaluate whether presentation devices may become eligible or active. The system can then immediately incorporate the eligible or active presentation devices into the bank-wide game effect.

In one example, a game effect controller, (e.g., a bank light show controller, a peer-to-peer light controller, a wagering game application, a server-side application on wagering game server, etc.) can perform a bank effect, such as a span lighting effect ("span effect"), or some other type of gaming effect. The game effect controller can present the bank effect continuously across a bank of presentation devices associated with one, or more, wagering game machines (e.g., a bank of wagering game machines). The presentation devices, associated with the bank of wagering game machines, however, may be experiencing events that have, or can be categorized as a having, higher priorities than the priority for the bank effect. The game effect controller that controls the bank effect can receive presentation status information from all of the presentation devices within the bank (e.g., via queries to, or broadcasts from, presentation devices and/or presentation device controllers within the bank, via queries to, or broadcasts from, lighting content sources that send lighting data to the presentation devices, etc.). The presentation status information can indicate one or more events that affect a state of availability, of each of the presentation devices, to present at least some portion, or accompanying portion, of the bank effect. Using the presentation status information, the game effect controller determines which of the presentation devices may be receiving content presentation commands (e.g., lighting commands) or that are presenting content (e.g., lighting content) that is higher in priority, or importance, than the priority or importance of the bank effect. For instance, the presentation status information can include lighting data received at emotive light controllers for a bank of wagering game machines. The lighting data can include priority values for light show numbers. The game effect controller can compare the priority values for the light show numbers with a priority value for the bank effect. The game effect controller can then use the comparison data to determine which of the presentation devices in the bank are receiving higher priority content presentation commands, or are associated with other presentation devices that have higher presentation priorities, and are, thus, ineligible to activate the bank effect.

Further, the game effect controller can ascertain network addresses for ineligible presentation devices and generate a synchronized bank effect that skips the addresses of ineligible presentation devices. For example, the game effect controller can send the bank effect data to only eligible devices. In some examples, the bank effect can have a distinct content element that is presented at some portion, or during some time interval, of the bank effect. The distinct content element can be a visually distinct lighting element (e.g., a specific light pattern, a distinct color combination, a unique LED image, etc.) included in the presentation of the bank effect. For instance, a bank effect may include a lighting effect that looks like a snake, with a very long body and a head. The head of the snake may be a visually distinct lighting element from the body of the snake (i.e., the body of the snake can span across multiple emotive lighting devices and may look visually monotonous, but the head has a visually unique look that sets it apart from the body). The game effect controller can determine whether the visually distinct lighting element could potentially be left out of the bank effect if it were to send lighting data to an ineligible lighting device that would not present the lighting data when received (e.g., if the snake effect were sent to an ineligible emotive lighting device, the head of the snake may disappear from view because the ineligible emotive lighting device would be unavailable to present the snake effect). In some embodiments, the visually distinct lighting element may only be an interesting, notable, or unique part of a bank lighting effect. The bank lighting effect, thus, would only suffer aesthetically from omission of the visually distinct lighting element. In other embodiments, however, the visually distinct lighting element may be critical, necessary, revelatory, outcome determinate, or in some other way, convey an important purpose, or function, of the bank effect (e.g., the head of the snake stops at a wagering game machine, which indicates the winner of a community wagering game). In other words, the distinct content element reveals a gaming outcome, and, according to presentation rules for the gaming outcome, the distinct content element is required to be presented at all times during the bank gaming effect. In such as case, omission of the visually distinct lighting element would not only have an aesthetic consequence, but may actually defeat the purpose of presenting the bank effect if it were to be omitted. As a result, the game effect controller can ensure that ineligible presentation devices are omitted, or excluded, from participating as nodes in the bank lighting effect. For instance, the game effect controller can exclude the ineligible presentation devices from receiving transmissions of the bank lighting effect. For instance, the game effect controller can generate a transmission schedule that would entirely omit transmission of lighting data to ineligible presentation devices. The transmission schedule can be a control matrix that synchronizes the timing of transmissions of emotive lighting control data. In other words, the game effect controller can generate a transmission schedule that sends emotive lighting control transmission to only eligible presentation devices, treating the ineligible presentation devices as if they were non-existent. The game effect controller thus synchronizing the bank effect so that it does not omit the presentation of the visually distinct lighting element (e.g., does not omit the presentation of the snake's head). The game effect controller thus ensures a continuous, synchronized light effect pattern between only the eligible, participating nodes (e.g., eligible presentation devices) that would not omit the visually distinct content element from the synchronized bank effect for any period of time.

In some embodiments, as stated previously, the ineligible presentation devices may be ineligible because control data received at those presentation devices has higher priorities than the priority for the bank effect. However, other events, other than those that produce emotive lighting effects, can also provide priorities that would make the presentation device ineligible. The other events can include gaming events, maintenance events, marketing events, sound events, etc., that may not necessarily use emotive lighting devices associated with a wagering game machine, but may have priorities for the events that would trump the presentation of some, or all, emotive lighting. For example, a wagering game machine may present an advertisement on a wagering game machine display. The advertisement may have a high priority that prevents, or warrants the prevention of, some or all emotive lighting presentations that would distract from the advertisement's presentation. Thus, the presentation status information that the game effect controller receives from a presentation device in the bank can include game activity data, maintenance activity data, marketing activity data, sound data, etc. The game effect controller, thus, can manage priorities for all types of data and can determine subsets of presentation devices, within a bank, that are ineligible for a bank effect and can exclude the ineligible presentation devices from the bank effect. The game effect controller can also determine subsets of eligible presentation devices and include the eligible presentation devices in the bank effect.

In another example, some other events may accompany emotive lighting events, but may have priorities that make emotive lighting devices ineligible even if the emotive lighting devices are available to present the bank effect. For example, the game effect controller can evaluate sound effects that accompany the bank effect and determine whether the sounds effects are audibly distinct. For example, the bank effect can include sound effects that accompany an emotive lighting effect. The sound effects may be audibly distinct during a portion of the emotive lighting effect. For instance, a portion of the emotive lighting effect may not be visually distinct but the sound produced by an associated speaker, for example, for that portion of the emotive lighting effect, may be audibly distinct from other sound effects that accompany the emotive lighting effect. For example, an emotive light show may include audibly distinct sound elements that beep at given intervals on speakers within a bank of wagering game machines. Thus, if a speaker, or other sound production device, associated with an emotive lighting device, is unavailable to present the audibly distinct sound element, the game effect controller could exclude the emotive lighting device from receiving lighting data for the bank effect because the accompanying audio device is unavailable. Thus, even though the emotive lighting device associated with the speaker is eligible to present lighting content, the distinct content element is associated with the speakers, which are unavailable, and, thus, the game effect controller treats the emotive lighting device as ineligible.

Further, still referring to excluding ineligible presentation devices, in some embodiments, the system can send bank effect control data to ineligible presentation devices as well as to eligible presentation devices. The system can include exclusionary instructions in the bank effect control data. A content controller for an ineligible presentation device can evaluate the exclusionary instructions and determine to skip presentation of the bank effect based on the exclusionary instructions. For instance, the exclusionary instructions can include a priority value for the bank effect. The content controller for the ineligible device can receive the priority value, included in the bank effect control data, and determine whether the priority value for the bank effect control data is higher than a priority values for other game effect data (e.g., see processing block 306) also received by the content controller. If the other game effect data has a higher priority value, the content controller can present the higher priority data first, and ignore, or suspend, the presentation of the bank effect control data. In other embodiments, the system can include "pass" instructions in the exclusionary instructions. The pass instructions can instruct the content controller to ignore the bank effect control data, or pass presentation of the bank effect to a neighboring presentation node (e.g., a neighboring eligible presentation device in the bank of presentation devices). After time, the ineligible presentation device may become eligible (e.g., once a higher priority, game effect command completes its presentation on the ineligible presentation device). The content controller can, therefore, immediately begin presenting the bank effect on the presentation device because the content controller is already receiving the bank effect control data. Thus, in some embodiments, the content controller does not have to wait for the game effect controller to re-evaluate the availability of the presentation device or wait for the game effect control to begin sending bank effect control data because the content controller has been receiving the bank effect control data all along.

In some embodiments, the emotive light presentation data can be related to network lighting effects. The following is a list of some example purposes for which the system can activate network lighting effects according to some embodiments: complimentary awards, community games, secondary games, maintenance, casino-wide progressive games, network celebrations, network reveals, mystery reveals, casino-wide events, etc.

The flow 300 continues at processing block 304, where the system determines a first priority value for the first emotive light presentation data and determines a second priority value for the second emotive light presentation data. In some embodiments, the priority values (first priority value or second priority value) can be a bit in a command, an instruction, a parameter, etc., included in emotive light presentation data. In some embodiments, the system can provide configuration tools for an operator to indicate or assign priority values for different shows, different activities, etc. The system can store configured priority rules and make the priority rules accessible to all wagering game machines and their ELCs.

FIG. 4 illustrates an example of a wagering game configuration system ("system") 400 including a configuration server 490 connected, via a communications network 422, to a casino network emotive light controller 480, a wagering game server 450, and a wagering game machine 460. The configuration server 490 can generate priority values 402 for emotive lighting presentation data for a variety of conditions and situations. For instance, the configuration server 490 can present a first configuration user interface ("first interface") 401 through which a user can select show numbers from a show number selection control 403 and assign priorities number values to the show number values using a priority value assignment control 405. The configuration server 490 can store the selected priority number values as associate them with selected show numbers within the priority values 402 (e.g., a file, a database, etc.). The system 400 can then make the priority values 402 available to the casino network emotive lighting controller 480, the wagering game server 450, and the wagering game machine 460 via the communications network 422. Further, the system 400 can present a second configuration user interface ("second interface") 410, with advanced configuration features. For instance, the second interface 410 can include a type selection control 412 for a user to select activity types, functional requirement types, device types, event types, etc. (e.g., types of wagering game activity, types of light show types, etc.). The second interface 410 can also include a priority value assignment control 414, which assigns a priority to the selected type in the type selection control 412. The second interface 410 can present a show number list 416 that indicates the show numbers that meet the type, criteria, or other value within the type selection control 412. In some embodiments, some show numbers may fall into more than one category or type. The second interface 410 can present show numbers that may be assigned different priority values and present options to further customize the priority value for the show number. In some embodiments, the configuration server 490 can also present functionality for user to assign priorities to sub-levels, or sub-classifications, of types, shows, etc. In one embodiment, for example, the second interface 410 can present a divisible selector 418 that permits further priority value configuration for different locations on a wagering game machine and accompanying peripheral devices. The configuration server 490 can present an emotive lighting location priority interface ("location interface") 420. The location interface 420 can include a location section 427 that specifies a location of emotive lighting devices on a wagering game machine. The location interface 420 can also include a sub-priority section 426 that includes first-level sub-priority selectors 430 for each of the locations listed for the location section 427 and second-level sub-priority selectors 431 for the first-level priority selectors 430. The first level sub-priority selectors 430 and second level sub-priority selectors 431 can indicate relative priorities for the location based on the type indicated in the type selection control 412. The location interface 420 can also include an instructions section 425 for indicating customized instructions, such as whether the location can be overridden by lower priority commands. For example, the "top-box" location has a priority value of "2" and is capable of being overridden for use by other lighting commands that may have a lower priority than that indicated in the priority value assignment control 414.

FIG. 6 below illustrates an example of overriding priorities which indicates an example of a lower priority bank attract effect overriding a higher priority application celebratory show but only for a specific location of the wagering game machine. In other words, the celebratory show, which would normally have access to emotive lights on the top and the sides of a wagering game machine cabinet based on its higher priority, can be overridden for the top emotive lights by the bank attract effect because the top lights are less effective for presenting the application's celebratory show. Because the top lights are less effective the bank attract effect is given access to the top lights while the celebratory effect is given access to the side lights.

Returning to FIG. 4, the location interface 420 can specify sub-priorities values that a wagering game system ("system") 600 in FIG. 6, for example, can refer to when determining whether to override priorities based on location.

Returning to FIG. 3, in some embodiments, if emotive light presentation data does not have a priority value, the system can dynamically assign a priority value based on distinct, ascertainable information from the application, the player, the light show, the environment, or events that occur on the system. Examples of distinct, ascertainable information may include, but are not limited to, information from the following: the emotive light presentation data, an associated game, a player, a game manufacturer, a time of day, a type of gaming application, a type of gaming event, a type of technology involved in the gaming application, a manufacturer of a gaming application, a marketing status for a gaming application, an application specification, a subject matter of a gaming application, a game genre for a gaming application, a player preference for a gaming application, player history associated with a gaming application, etc. In some embodiments, the system may assign priority values based on activity types or priority assignation rules. For instance, the system can determine activities that may have revenue generating capabilities (e.g., attracts of new or interesting games, activation of games by players, downloads of requested wagering game data, etc.). The system could, for example, assign the revenue generating activity the highest priorities. In other embodiments, the system may determine game activities that are more significant than others. The system, for instance, may determine that presenting game reveals, or outcomes, has the highest priority over other game activities. Other activities may include community game activities, maintenance activities, mystery reveals, network attracts, bank attracts, game attracts, etc. For example, the system could determine that a local game attract could have a lower priority than a bank attract. The system can use the priority assignation rules for assigning priorities (e.g., the rules may indicate principles, or parameters, for priority assignation such as (1) game outcomes are greater than other revenue generating activity, (2) all revenue generating activity is greater than celebrations, (3) all community game activity is greater than attracts, (4) bank attracts are greater than game attracts, etc.).

The flow 300 continues at processing block 306, where the system prioritizes the first emotive light presentation data and the second emotive light presentation data based on the first priority value and the second priority value. In some embodiments, the system can determine priorities that simultaneously conflict with light presentation on the emotive lighting device. The system can prioritize the conflicts by determining which priority value is more significant, or that transcends other values according to a priority order (e.g., which priority value is higher in value for an ordering scheme where higher priority value numbers indicate priorities that are more significant).

The flow 300 continues at processing block 308, where the system controls the first emotive light presentation data and the second emotive light presentation data based on prioritization of the first priority value and the second priority value. For example, the system can stop, pause, kill, or ignore lower priority commands in favor of higher priority commands. For example, the system may ignore lower priority lighting commands sent via one source (e.g., a DMX controller) in favor of higher priority lighting commands sent by another source (e.g., a bank controller, a wagering game server, a wagering game machine application, etc.). In some embodiments, the system can coordinate the proper timing for handing off use of an emotive lighting device at the end of one higher priority command and activate the emotive lighting device for next highest priority.

For instance, in FIG. 5, a wagering game system ("system") 500 can include a casino network emotive lighting controller 550 and a bank show controller 540 (e.g., an application on a bank of wagering game machines) connected to a wagering game machine 560. The casino network emotive lighting controller 550 can be a DMX controller connected via a DMX network, which can connect directly to an emotive light controller 564 for the wagering game machine 560. The casino network emotive lighting controller 550 can be connected to wagering game servers, such as a progressive game server 580, which provides instructions to begin light shows for casino-wide content (e.g., for a progressive game for which multiple wagering game machines can be eligible across a casino). The bank show controller 540 can be connected via an EL Sync network connection, which can also connect directly to the emotive light controller 564. The emotive light controller 564 can control emotive lighting devices 590 associated with (e.g., surrounding) the wagering game machine 560. The bank show controller 540 can send lighting commands for a bank show 501 while the casino network emotive lighting controller 550 sends lighting commands for a network light show 502. The emotive light controller 564 can track the lighting commands in an emotive lighting data chart 510 including tracking the sources of the lighting commands and priority values (e.g., the bank show commands include a priority value of "21" and the DMX show commands include a priority value of "17"). The bank show 501 may include performing an EL Sync rainbow effect on emotive lighting devices 590 for the wagering game machine 560 for twenty-five frame counts. The emotive light controller 564 can determine that the priority value for the bank show 501 is higher than the priority value for the network light show 502. The emotive light controller 564 can ignore lighting commands for the network light show 502 during the twenty-five frame counts. During the 25 frame counts, however, the emotive light controller 564 can monitor the priority value of the network light show 502 to determine if it changes to a higher value. When the 25 frame counts end, or are about to end, the emotive light controller 564 can check for other lighting commands delivered to the wagering game machine 560, to determine if other lighting commands may have arrived that have a higher priority than the network light show 502. If, however, after the 25 frame count, there are no other commands with higher priorities, then the emotive light controller 564 can immediately implement the DMX commands (e.g., implement the chase effect on the emotive lighting devices 590). In some embodiments, the emotive light controller 564 can look at frame numbers and time stamps of when the next highest priority show (e.g., the chase effect) originally requested to begin (e.g., when the casino network emotive light controller 550 began playing the chase effect), then calculate a current frame for which to start playing the next highest priority light show as soon as the highest priority show (e.g., the rainbow attract) stops playing. Thus, the emotive light controller 564 can synchronize presentations on the emotive lighting devices 590 to begin immediately playing the next highest priority light show at the proper frame. Further, although FIG. 5 illustrates that a bank show controller 540 was given higher priority than the casino network emotive light controller 550. In other embodiments, the casino network emotive light controller 550 or other light data source (e.g., an application, a gaming server, etc.) may have higher priority to start out with.

Returning to FIG. 3, in some embodiments, the system can determine locations of emotive lighting devices on a wagering game machine and divide or override priority commands based on the locations. For example, the system can determine to implement a lower priority command to utilize a lesser important emotive lighting device if a higher priority command can have access to other more important emotive lighting devices that are important to the function for the higher priority command. FIG. 6 illustrates an example. In FIG. 6, a wagering game system ("system") 600, includes a wagering game machine 660 connected to a bank show controller 640. The bank show controller 640 can connect to an emotive light controller 664 associated with the wagering game machine 660. The bank show controller 640 can connect to the emotive light controller 664 (e.g., via an EL Sync network connection, via a DMX network connection, etc.). The emotive light controller 664 can also communicate with a wagering game application ("game") 602 on the wagering game machine 660 (e.g., via a central processing unit (CPU) 609 connected through a bus (e.g., USB)). The wagering game machine 660 includes emotive lighting devices 690 associated with (e.g., surrounding) the wagering game machine 660. The emotive light controller 664 can control the emotive lighting devices 690. The bank show controller 640 runs a bank attract show (bank show 601) configured to utilize both a top emotive light bar 618 and a side emotive light bar 620 on the wagering game machine 660 (e.g., the bank show controller 640 wants to color both the top emotive light bar 618 and the side emotive light bar 620 the color blue). At the same time, however, the game 602 may run a game effect 603 that is configured to also utilize both the top emotive light bar 618 and the side emotive light bar 620 on the wagering game machine 660 (e.g., the game effect 603 wants to color both the top emotive light bar 618 and the side emotive light bar 620 the color red). The bank show controller 640 and the game 602, therefore, provide conflicting lighting commands for the same emotive lighting devices 690. The emotive light controller 664, for the wagering game machine 660, can receive lighting commands from the bank show controller 640 and the game 602 and can consult priority values included in the lighting commands. In some embodiments, the priority values may be different or the same. The emotive light controller 664 can track priorities in a priority chart 610, which indicates that the game effect 603 has a higher priority than the bank show 601. The emotive light controller 664, however, can be configured to arbitrate the priorities so that portions of the game effect 603 and the bank show 601 can run on different parts, or locations, of the wagering game machine 660. For instance, the emotive light controller 664 can decide to bypass some priority values, in certain situations, based on "priority splitting" principles or rules. Priority splitting rules, for example, can balance benefits for the current player playing the game 602 against needs of attracting nearby players to a bank. As an example, the purpose of an attract show is to attract potential players from a distance. For attracting players from a distance, the top emotive light bar 618 may be the most important emotive lighting device because distant patrons may have a better view of top lights (i.e., not obscured by game chairs, current players, etc.). Therefore, the emotive light controller 664 can determine that the position of the top emotive light bar 618 is positioned to effectively convey the purpose, or function, of the attract show by being the most prominently positioned device that can be seen by distant casino patrons. At the same time, however, the emotive light controller 664 can determine that the position of the side emotive light bar 620 is positioned to effectively convey the purpose, or function, of the game 602 by being the most prominently positioned device that can be seen by the player that plays the game 602. Side lighting may be more beneficial for presenting game content than a top lighting because players can more readily see lighting in their periphery then above or below them. In one embodiment, the emotive light controller 664 can use minimal locality presentation requirements indicated in lighting instructions and/or accessed from configuration files, settings, or other storage locations. The minimal locality presentation requirements can indicate that the side emotive light bar 620 can present at least a part of an emotive lighting presentation that complies with locality presentation requirements for the game 602 (e.g., the game 602 includes settings that requires a celebratory explosion effect to expand side emotive lighting devices, but not necessarily to upper or lower emotive lighting devices). The minimum locality presentation requirements thus specify required locations (e.g., on emotive lighting devices for the wagering game machine 660), where required portions of an emotive lighting effect must be presented to meet the minimal functional requirements of the emotive lighting effect. The emotive light controller 664, thus, can give control of the side emotive light bar 620 to the game 602 and give control of the top emotive light bar 618 to the bank show controller 640 (i.e., as indicated in the results queue 614). Similarly, the system 600 can determine, according to minimal locality requirements, that the bank show 601 does not require the use of the side emotive light bar 620. If the bank show 601 did require the use of the side emotive light bar 620, according to its minimal locality requirements, then the emotive light controller 664 could refrain from overriding priority for the game effect 603. If the priority values for the bank show 601 and the game effect 603 are different, the system 600 can override the presentation priority of higher priority lighting command (e.g., the game effect 603, which has the higher priority) but only for the specific emotive lighting devices (e.g., the side emotive light bar 620) that meet the minimal functional requirements for the lower lighting commands (e.g., the bank show 601, which has the lower priority). In some embodiments, however, the emotive light controller 664 may determine that although the lower priority command (e.g., the bank show 601) may utilize the top emotive light bar 618 without significant distraction to the player, if the game 602 produces a lighting command with priority values within a certain range (e.g., a very high range of priority values), the emotive light controller 664 would refrain from overriding the priority. For example, a celebratory effect for a very high win amount may have a very high priority value, assigned by an operator during configuration, because the operator believes that the celebratory effect would have a greater advertising effect on patrons than a bank attract would. The emotive light controller 664, thus, could refrain from overriding priorities that are inside the range of higher priority values. Thus, when the game 602 produces a very high priority game effect (e.g., a celebratory effect for a very high win amount) the emotive light controller 664 could refrain from overriding any portion of the very high priority game effect and thus give full priority to the very high priority game effect to utilize both the top emotive light bar 618 and the side emotive light bar 620. In some embodiments, the system 600 may also split priorities for other devices such as peripheral displays. Returning to FIG. 3, in some embodiments, the system can determine that priorities levels are the same (e.g., equally as high) for lighting commands from more than one source. The system can determine, based on a hierarchy of rules, which lighting command will receive priority. For example, the system may determine that emotive light data that comes from an application is generally given preference over other types of data, unless the priority values from the other types of data are within a high enough value range. In some embodiments, the system can hold priority in stasis during non-responsive activity of an activated process, such as holding the priority in stasis if downloading information. For instance, the system can determine that a lighting command from an application has the highest priority at a given time, but the application needs to download data or perform some other activity that may delay the presentation of the lighting command. The system can allow other commands (e.g., a bank attract in process) to precede the priority of the application's lighting command during the download or during the performance of the other delaying activity, but as soon as the download is ready to present, or the other delaying activity has completed, the system can reinstate the original priority.

Figure 7:
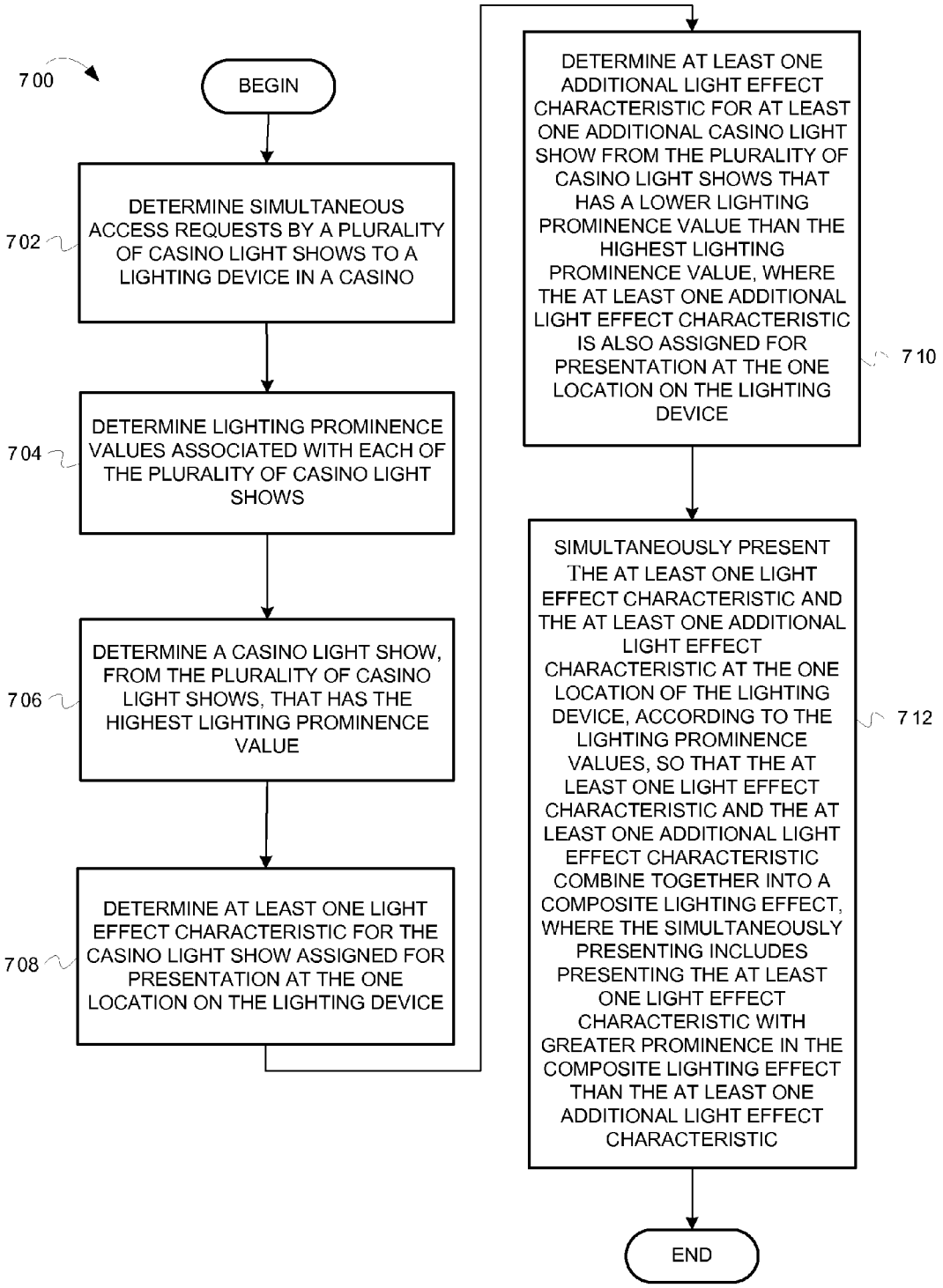
FIG. 7 is a flow diagram 700 illustrating presenting multiple casino light shows on a casino lighting device as a composite lighting effect at one location of the lighting device, according to some embodiments.

FIG. 7 is a flow diagram ("flow") 700 illustrating presenting multiple casino light shows on a casino lighting device as a composite lighting effect at one location of the lighting device, according to some embodiments. In FIG. 7, the flow 700 begins at processing block 702, where a wagering game system ("system") determines simultaneous access requests by a plurality of casino light shows to a lighting device in a casino.

The flow 700 continues at processing block 704, where the system determines lighting prominence values associated with each of the plurality of casino light shows.

The flow 700 continues at processing block 706, where the system determines a casino light show, from the plurality of casino light shows, that has the highest lighting prominence value.

The flow 700 continues at processing block 708, where the system determines at least one light effect characteristic for the casino light show assigned for presentation at the one location on the lighting device.

The flow 700 continues at processing block 710, where the system determines at least one additional light effect characteristic for at least one additional casino light show from the plurality of casino light shows that has a lower lighting prominence value than the highest lighting prominence value, where the at least one additional light effect characteristic is also assigned for presentation at the one location on the lighting device.

The flow 700 continues at processing block 712, where the system simultaneously presents the at least one light effect characteristic and the at least one additional light effect characteristic at the one location of the lighting device, according to the lighting prominence values, so that the at least one light effect characteristic and the at least one additional light effect characteristic combine together into a composite lighting effect, where the simultaneously presenting includes presenting the at least one light effect characteristic with greater prominence in the composite lighting effect than the at least one additional light effect characteristic.

FIGS. 8, 9, 10A, 10B, and 11 are conceptual diagrams that help illustrate some examples of the flow of FIG. 7, according to some embodiments. The wagering game system referred to in FIG. 7 may also be referred to in descriptions of FIGS. 8, 9, 10A, 10B, and 11. In some embodiments, the system can utilize lighting prominence values that relates to levels of priority, or priority levels. The priority levels can be applied to light effect characteristic for each casino light show while being played simultaneously, and on the same lighting device, so that the light effect characteristics combine, or blend, together into the composite lighting effect.

For example, the system can associate priority levels with alpha channel values that indicate alpha layering prominence. The system can then combine, or blend, the layers in a way that provides the equivalent prominence to layers based on their priority values (e.g., provides highest prominence to the layer that has the highest, or most significant, priority level, the next highest prominence to the next layer that has the next highest priority level, etc.). More specifically, the system can prioritize casino network lighting commands using priority values and transparency values, according to some embodiments, as illustrated in FIG. 8. In FIG. 8, a wagering game system ("system") 800 can include a casino network emotive lighting controller ("network lighting controller") 850 and a bank show controller 840 (e.g., an application on a bank of wagering game machines) associated with an emotive lighting device 860. The network lighting controller 850 can be a DMX controller connected via a DMX network, which can connect directly to an emotive light controller 864 for the emotive lighting device 860. The casino network emotive lighting controller 850 can be connected to wagering game servers, which provide instructions to begin light shows for casino-wide content (e.g., for a progressive game for which multiple wagering game machines can be eligible across a casino). The bank show controller 840 can be connected via an EL Sync network connection, which can also connect directly to the emotive light controller 864. The emotive light controller 864 can control one or more emotive lighting elements 890 associated with the emotive lighting device 860. The bank show controller 840 can send lighting commands for a lighting effect 801 (e.g., a rainbow lighting effect) associated with bank show while the casino network emotive lighting controller 850 sends lighting commands for a lighting effect 802 (e.g., a chase lighting effect) associated with a network light show. The system 800 can also include a wagering game application ("game") 809 and a central processing unit (CPU) 812 associated with a wagering game machine that is associated with the emotive lighting device 860. The emotive light controller 864 can communicate with the game 809 via the CPU 812. The emotive light controller 864 can be connected to CPU 812 via a universal serial bus. The game 809 may send lighting commands for a lighting effect 803 to be presented on any of the emotive lighting elements 890 of the emotive lighting device 860. The emotive light controller 864 can determine simultaneous access requests by the network lighting controller 850, the bank show controller 840, and the game 809 to present light shows effects (e.g., the lighting effect 801, the lighting effect 802, and the lighting effect 803) on any one or more of the emotive lighting elements 890 of the emotive lighting device 860. The emotive light controller 864 can determine lighting priority values and transparency values associated with each of the light show effects. For example, the emotive light controller 864 can track the lighting commands in an emotive lighting data chart 810 including tracking the sources of the lighting commands, light effect descriptions, timing values, priority values (e.g., game show commands include a priority value of "150", bank show commands include a priority value of "80" and network light show commands include a priority value of "50"), transparency values (e.g., game show commands include a transparency value of "128", bank show commands include a transparency value of "0" and network light show commands include a transparency value of "64"), and emotive light control instructions. In some embodiments, some or all of the priority values and/or transparency values can be different. In other embodiments, however, some or all of the priority values and/or transparency values can be the same values. In FIG. 8, they are all different. The priority values and transparency values can be included in emotive lighting commands, or date the flows in channels that carry emotive lighting commands, for a show or for various parts of a show. The priority values can define a rendering order of light presentation layers for each of the light effects 801, 802, and 803. The priority values, thus, can specify prominence significance of the light effects 801, 802, and 803. The transparency values can define a degree of transparency of the light presentation layers and can range, for example, from values of 0-255 for a 256-bit show channel. The 0-255 values indicate a range of transparency ranging from 0% transparent for the "0" value to 100% transparent for the "255" value. One of the channels for each show is can be an alpha-layering-value channel. The alpha-layering-value channel indicates which portions of the shows are see-through (i.e., specifies the transparency). Thus, the priority values indicate a layering order of the light effects 801, 802, and 803 and the transparency values indicate a numerical degree to which each layer is see-through. The light effects 801, 802, and 803 can play, or be presented on top of each other, with each light effect having its own light presentation layer with its own transparency value. Light characteristics of each of the light effects 801, 802, and 803, such as colors, can bleed through each other to make a blended color combination, or composite color. The show transparency values also allow effects to show through for an underlying show so that multiple effects are displayed at the same time at the same lighting device element or location. More specifically, the emotive light controller 864 can determine a first casino light show, from the plurality of casino light shows, that has the highest lighting priority value. In the example of FIG. 8, the casino light show with the highest lighting priority value is the game application's light effect 803. The emotive light controller 864 can determine a transparency value associated with the highest priority light show (i.e., the transparency value of "128" for the light effect 803). On a scale of 0-255 values, the number "128" represents a 50% transparency value. Thus, the highest priority light show (i.e., the light effect 803) allows itself to be 50% see-through. In some embodiments, however, transparency values can be assigned to only a portion of a lighting effect for a show (e.g., to edges of a light-effect image only and not a central portion of the light-effect image). Thus, the 50% transparency value may apply only to specific parts of the light effect 803. The highest priority light, therefore, allows other shows' light effects to be seen through a 50% transparent upper layer. The emotive light controller 864 can also determine all transparency values for all other light shows with lesser priorities. The emotive light controller 864 can check the transparency values of each of the plurality of shows, by descending priority levels, starting with the highest priority casino light show that has the highest priority level until finding a lowest priority show whose transparency value does not allow transparency. In the example of FIG. 8, the emotive light controller 864 does not have to check far before finding a lower priority show whose transparency value does not allow transparency since the next lowest priority show (i.e., the light effect 801) has a transparency value of "0." In other examples, however, there may be multiple shows that allow transparency before finding one that does not. In yet other examples, all shows may allow transparency. In such a case, the emotive light controller 864 may automatically assign a transparency value of "0" (i.e., a non-transparent value) to the lowest priority show. In some embodiments, the emotive light controller 864 can also check business rules to determine whether transparencies can or cannot be allowed, regardless of transparency values already assigned to a show (e.g., based on a game theme). In FIG. 9, a wagering game system ("system") 900 may include an emotive light controller 964 connected to a light effect business rules store 967. One business rule may specify that if a win value (as indicated by a wagering game content controller 961) is over a certain win amount (e.g., over $5,000), then a light show associated with the win value cannot be transparent (e.g., does not allow additional shows to be presented through the light show associated with the win value over the certain win amount). In FIG. 9, for instance, a win amount is $6,458, which is over the $5,000 business rule indicated by the light effect business rules store 967. Consequently, the emotive light controller 964 could force the win effect for the game app to activate on a lighting element without transparency.

Figure 10A:
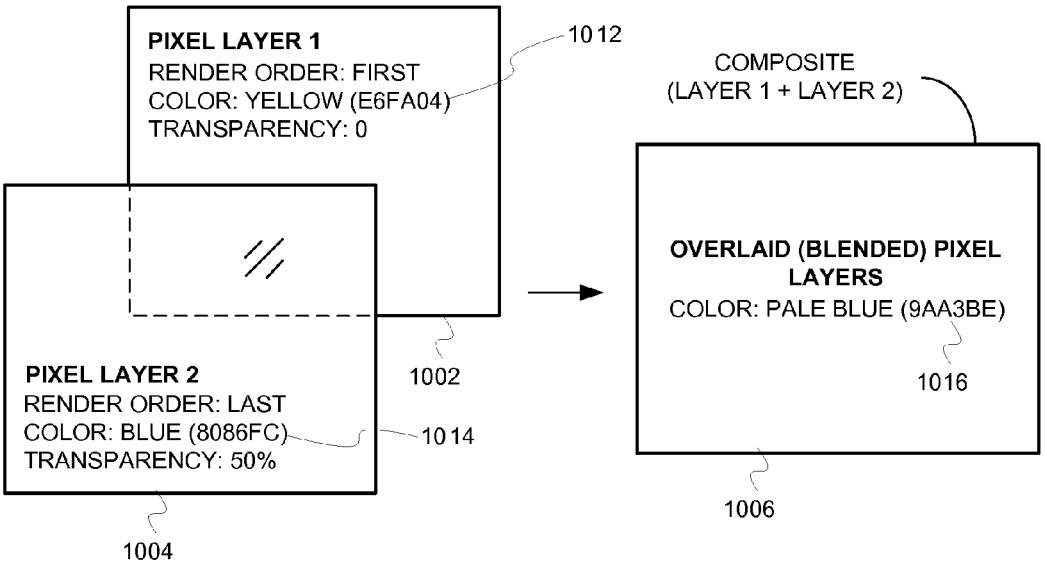
FIG. 10A is an illustration of generating a composite lighting effect using blended layers, according to some embodiments.
Figure 10B:
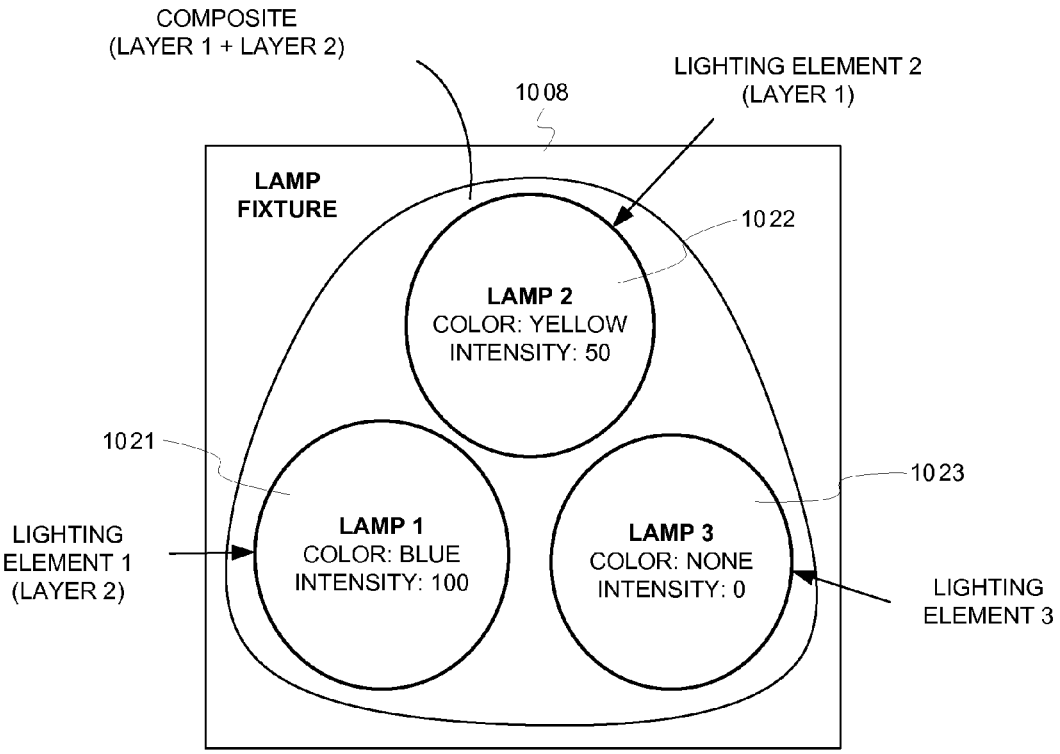
FIG. 10B is an illustration of generating a composite lighting effect using light source groupings, according to some embodiments.
Figure 11:
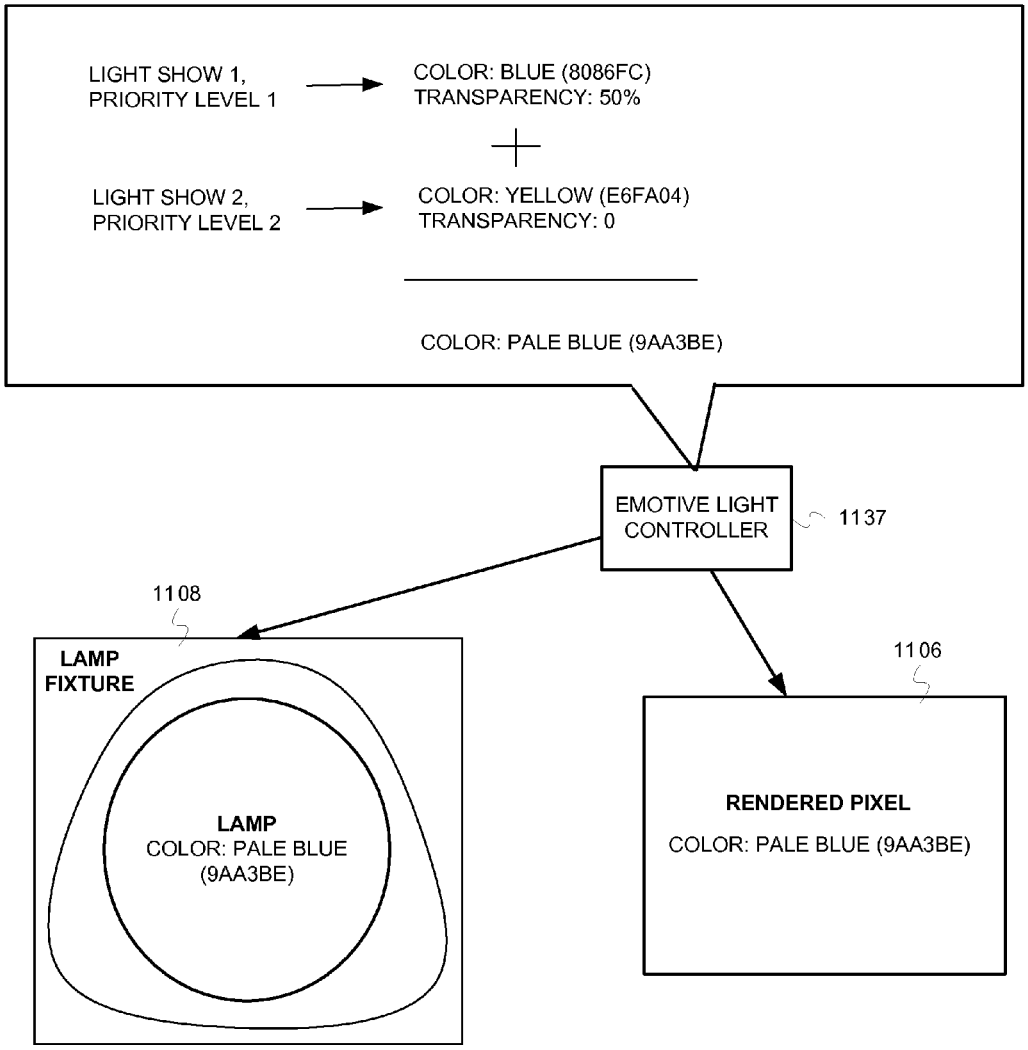
FIG. 11 is an illustration of computationally compositing light characteristic values and prominence values to generate a composite lighting effect result, and using the composite lighting effect result to present a composite light effect, according to some embodiments.

Returning to FIG. 8, however, the emotive light controller 864 checked the transparency values of each of the plurality of casino shows, by descending priority levels, starting with the highest priority casino light show that has the highest priority level (i.e., the lighting effect 803 with the priority value of "150", which allows a 50% transparency) and continued in the descending order (e.g., next checked the lighting effect 801 with the priority value of "80", which allows a 0% transparency) until finding a lowest priority show whose transparency value does not allow transparency (the lighting effect 801). The emotive light controller 864 then can determines that it can blend, or layer, light effect characteristics in two layers, the first being for the highest priority light show (i.e., the lighting effect 803) and the second being for the second highest priority light show (i.e., the lighting effect 801). One example of a light effect characteristic is a light intensity or power value. Another light effect characteristics is a color value. Therefore, for an example, emotive light controller 964 can determine an initial color value for the lowest priority light show that does not allow transparency (i.e., the lighting effect 801, which has the transparency value of "0"). The color value may be addressed to a portion of emotive lighting device 860, such as one lighting element 895 of the emotive lighting elements 890. The emotive light controller 864 can then render an initial light presentation layer of the initial color value for the lighting element 895. The emotive light controller 864 can then consecutively determine, according to an ascending priority value, additional color values addressed to the lighting element 895 for additional light shows and consecutively render subsequent light presentation layers in ascending order of priority using respective transparency values until rendering a final light presentation layer assigned to the highest priority light show. The emotive light controller 864 can thus present a blended color on the lighting element 895 that combines the initial light presentation layer of the initial color value as well as the subsequent light presentation layers according to the respective transparency values. In FIG. 10A, for example, the emotive light controller 864 can blend a first pixel layer 1002 with a second pixel layer 1004. The first pixel layer 1002 has a first color value 1012 (e.g., a yellowish color with a color value of E6FA04) and the second pixel layer 1004 has a second color value 1014 (e.g., a bluish color with a color value of 8086FC). The emotive light controller 864 can render the first pixel layer 1002 first because it has the lowest priority value of the two layers. The emotive light controller 864 can render the second pixel 1004 last because it has the highest priority value, and therefore can have the highest prominence of the two layers. The layering effect causes a composite layer (e.g., a layered, or blended, pixel 1006), with a color value of 9AA3BE, which is the composite color that results by overlaying the bluish color at 50% transparency onto the yellowish color at 0% transparency. The example of FIG. 10A works well with technologies that permit color layering, such as light emitting diode displays. In other examples, however, for technologies that do not permit color layering, the emotive light controller 864 can utilize lighting prominence values for light effect blending using light source groupings where one lamp light source gets greater prominence in the grouping than other lamp sources. In FIG. 10B, for example, the emotive light controller 864 may want to create a composite lighting effect, but a lamp fixture 1008 does not have layered display elements. Instead, it has a grouping of lamps, including a first lamp 1021, a second lamp 1022, and a third lamp 1023. The grouping of lamps are not overlapping but are sufficiently close to each other in proximity that depending on the size of the lamps, and the distance to an observer, the light that is generated from the lamps can blend together to appear as a single lighting element, or light source, even though three lamps are producing separate colors. The emotive light controller 864 can make use of the multiple lamps in a way that closely correlates to the layering concept, such as by adjusting the colors of the lamps and their light intensities to generate a composite color that is similar to the color value produced by the blended pixel 1006. In one example, the emotive light controller 864 may utilize the priority values associated with the shows and adjust them to find corresponding intensity levels (e.g., an inverse proportion where a highest priority value produces a higher intensity value and a lower priority value produces a lower intensity value). The emotive light controller 864 may also utilize different light colors for the lamps that generate the composite color when viewed from a distance.

In other example, the system does not present multiple light presentation layers or elements with one having greater prominence. Instead, the system can computationally composite light characteristic values and prominence values to generate a composite lighting effect result, and use the composite lighting effect result to present a composite lighting effect. For instance, the system can pre-determine the composite lighting effect using a compositing algorithm, and applying the prominence values during the processing of the algorithm (e.g., passing in priority values and/or transparency values into the algorithm), to generate a computational (e.g., simulated, mathematical, etc.) composite lighting effect result ("composite result") of the composite lighting effect. The system can then use the computational composite result to present the composite lighting effect on one lighting source. For instance, in FIG. 11, an emotive light controller 1137 computationally combines the bluish color and the yellowish color to determine the composite color value. Then the emotive light controller 1137 can provide the composite color value to a lighting element (e.g., an overhead lamp 1108) or use the composite color value to generate a single layer (e.g., a single rendered pixel 1106).

It should also be noted that players, as well as professionally trained casino light show operators, can configure the system. For example, players can configure the system with player preferences regarding show values and/or business rules. For example, players can specify priorities, lighting characteristics, transparency values, business rules, etc.

Additional Example Operating Environments

This section describes example operating environments, systems and networks, and presents structural aspects of some embodiments.

Wagering Game Machine Architecture

Figure 12:
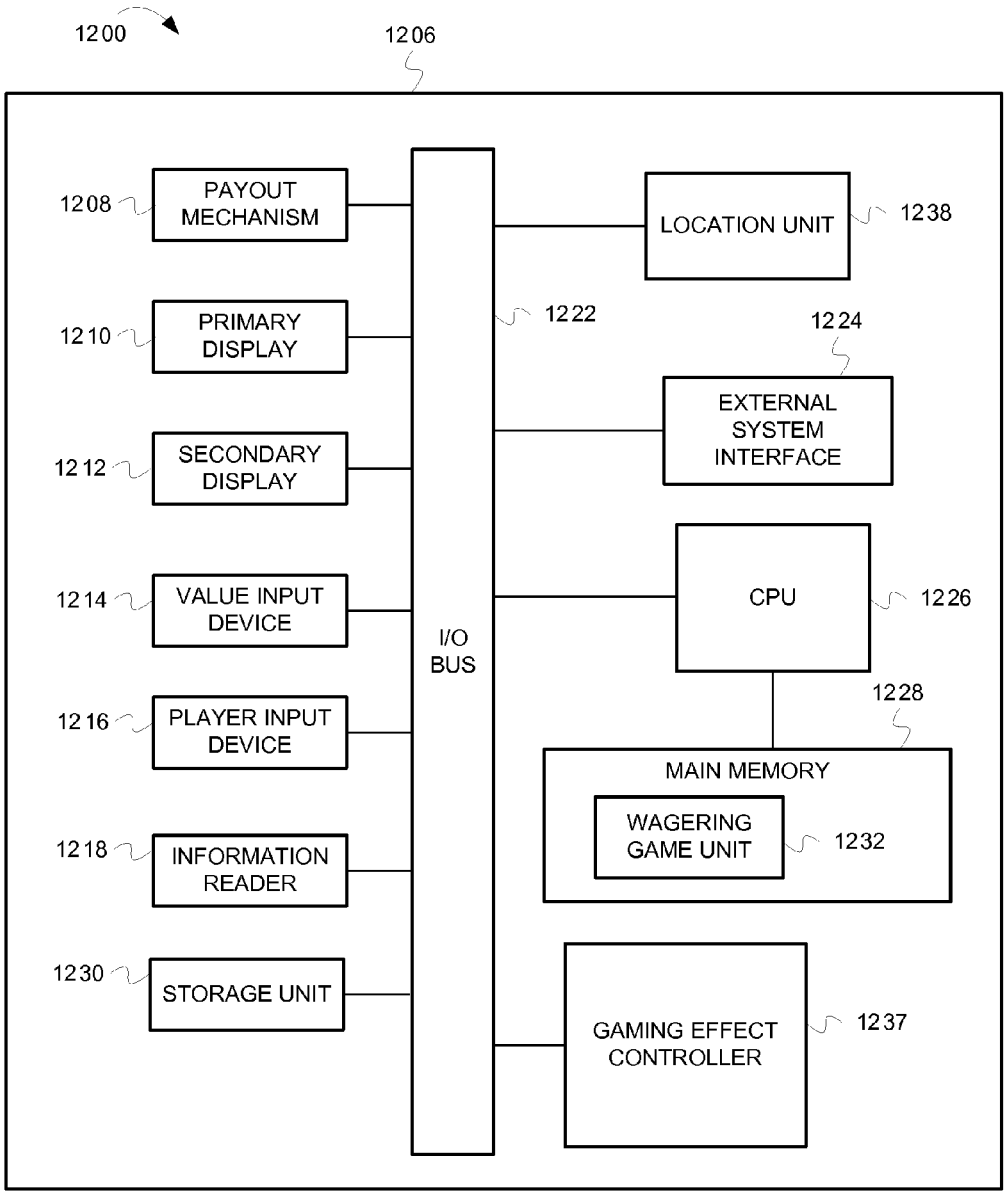
FIG. 12 is an illustration of a wagering game machine architecture 1200, according to some embodiments.

FIG. 12 is a conceptual diagram that illustrates an example of a wagering game machine architecture 1200, according to some embodiments. In FIG. 12, the wagering game machine architecture 1200 includes a wagering game machine 1206, which includes a central processing unit (CPU) 1226 connected to main memory 1228. The CPU 1226 can include any suitable processor, such as an Intel® Pentium processor, Intel® Core 2 Duo processor, AMD Opteron™ processor, or UltraSPARC processor. The main memory 1228 includes a wagering game unit 1232. In some embodiments, the wagering game unit 1232 can present wagering games, such as video poker, video black jack, video slots, video lottery, reel slots, etc., in whole or part.

The CPU 1226 is also connected to an input/output ("I/O") bus 1222, which can include any suitable bus technologies, such as an AGTL+ frontside bus and a PCI backside bus. The I/O bus 1222 is connected to a payout mechanism 1208, primary display 1210, secondary display 1212, value input device 1214, player input device 1216, information reader 1218, and storage unit 1230. The player input device 1216 can include the value input device 1214 to the extent the player input device 1216 is used to place wagers. The I/O bus 1222 is also connected to an external system interface 1224, which is connected to external systems (e.g., wagering game networks). The external system interface 1224 can include logic for exchanging information over wired and wireless networks (e.g., 802.11g transceiver, Bluetooth transceiver, Ethernet transceiver, etc.)

The I/O bus 1222 is also connected to a location unit 1238. The location unit 1238 can create player information that indicates the wagering game machine's location/movements in a casino. In some embodiments, the location unit 1238 includes a global positioning system (GPS) receiver that can determine the wagering game machine's location using GPS satellites. In other embodiments, the location unit 1238 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 12, in some embodiments, the location unit 1238 is not connected to the I/O bus 1222.

In some embodiments, the wagering game machine 1206 can include additional peripheral devices and/or more than one of each component shown in FIG. 12. For example, in some embodiments, the wagering game machine 1206 can include multiple external system interfaces 1224 and/or multiple CPUs 1226. In some embodiments, any of the components can be integrated or subdivided.

In some embodiments, the wagering game machine 1206 includes a gaming effect controller 1237. The gaming effect controller 1237 can process communications, commands, or other information, where the processing can control wagering game content and effects (e.g., light effects, sound effects, etc.).

Furthermore, any component of the wagering game machine 1206 can include hardware, firmware, and/or machine-readable media including instructions for performing the operations described herein.

Wagering Game Machine

Figure 13:
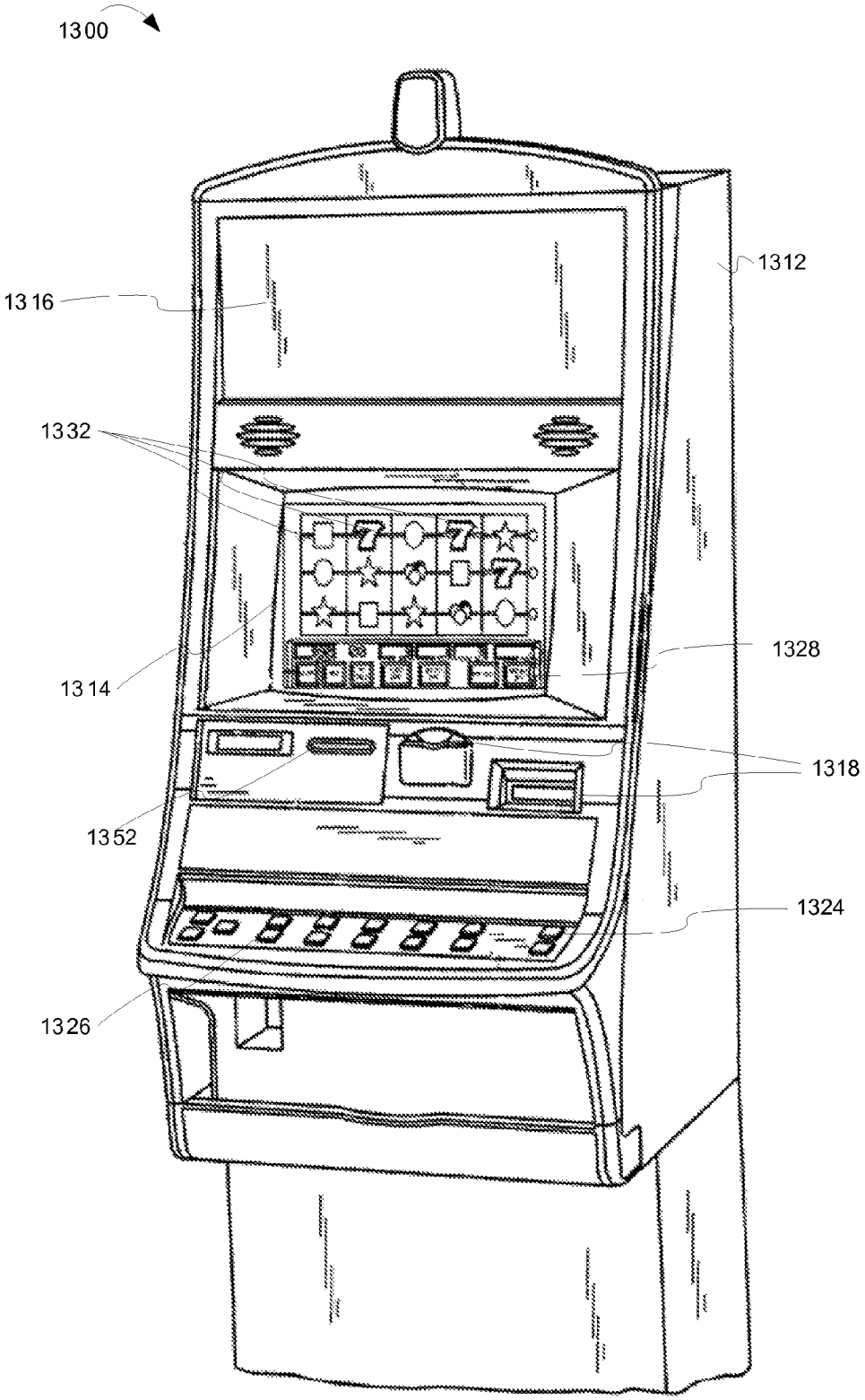
FIG. 13 is an illustration of a wagering game machine 1300, according to some embodiments.

FIG. 13 is a conceptual diagram that illustrates an example of a wagering game machine 1300, according to some embodiments. Referring to FIG. 13, the wagering game machine 1300 can be used in gaming establishments, such as casinos. According to some embodiments, the wagering game machine 1300 can be any type of wagering game machine and can have varying structures and methods of operation. For example, the wagering game machine 1300 can be an electromechanical wagering game machine configured to play mechanical slots, or it can be an electronic wagering game machine configured to play video casino games, such as blackjack, slots, keno, poker, blackjack, roulette, etc.

The wagering game machine 1300 comprises a housing 1312 and includes input devices, including value input devices 1318 and a player input device 1324. For output, the wagering game machine 1300 includes a primary display 1314 for displaying information about a basic wagering game. The primary display 1314 can also display information about a bonus wagering game and a progressive wagering game. The wagering game machine 1300 also includes a secondary display 1316 for displaying wagering game events, wagering game outcomes, and/or signage information. While some components of the wagering game machine 1300 are described herein, numerous other elements can exist and can be used in any number or combination to create varying forms of the wagering game machine 1300.

The value input devices 1318 can take any suitable form and can be located on the front of the housing 1312. The value input devices 1318 can receive currency and/or credits inserted by a player. The value input devices 1318 can include coin acceptors for receiving coin currency and bill acceptors for receiving paper currency. Furthermore, the value input devices 1318 can include ticket readers or barcode scanners for reading information stored on vouchers, cards, or other tangible portable storage devices. The vouchers or cards can authorize access to central accounts, which can transfer money to the wagering game machine 1300.

The player input device 1324 comprises a plurality of push buttons on a button panel 1326 for operating the wagering game machine 1300. In addition, or alternatively, the player input device 1324 can comprise a touch screen 1328 mounted over the primary display 1314 and/or secondary display 1316.

The various components of the wagering game machine 1300 can be connected directly to, or contained within, the housing 1312. Alternatively, some of the wagering game machine's components can be located outside of the housing 1312, while being communicatively coupled with the wagering game machine 1300 using any suitable wired or wireless communication technology.

The operation of the basic wagering game can be displayed to the player on the primary display 1314. The primary display 1314 can also display a bonus game associated with the basic wagering game. The primary display 1314 can include a cathode ray tube (CRT), a high resolution liquid crystal display (LCD), a plasma display, light emitting diodes (LEDs), or any other type of display suitable for use in the wagering game machine 1300. Alternatively, the primary display 1314 can include a number of mechanical reels to display the outcome. In FIG. 13, the wagering game machine 1300 is an "upright" version in which the primary display 1314 is oriented vertically relative to the player. Alternatively, the wagering game machine can be a "slant-top" version in which the primary display 1314 is slanted at about a thirty-degree angle toward the player of the wagering game machine 1300. In yet another embodiment, the wagering game machine 1300 can exhibit any suitable form factor, such as a free standing model, bar top model, mobile handheld model, or workstation console model.

A player begins playing a basic wagering game by making a wager via the value input device 1318. The player can initiate play by using the player input device's buttons or touch screen 1328. The basic game can include arranging a plurality of symbols along a pay line 1332, which indicates one or more outcomes of the basic game. Such outcomes can be randomly selected in response to player input. At least one of the outcomes, which can include any variation or combination of symbols, can trigger a bonus game.

In some embodiments, the wagering game machine 1300 can also include an information reader 1352, which can include a card reader, ticket reader, bar code scanner, RFID transceiver, or computer readable storage medium interface. In some embodiments, the information reader 1352 can be used to award complimentary services, restore game assets, track player habits, etc.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system comprising:

analyzing, via an electronic processing unit of the gaming system, electronic information received via a network communication interface of the gaming system, wherein the electronic information is associated with a first gaming effect and a second gaming effect provided for concurrent presentation via a first output device associated with the gaming system;

determining, via the electronic processing unit based on the analyzing, that the first gaming effect has a higher priority than the second gaming effect for presentation via the first output device;

causing, via the electronic processing unit, presentation of the first gaming effect via the first output device before presentation of the second gaming effect based on the higher priority;

preventing, via the electronic processing unit without user input, presentation of a first portion of the second gaming effect via the first output device while the first gaming effect is being presented via the first output device;

electronically determining, via the electronic processing unit, that a second portion of the second gaming effect is available for presentation via the first output device after an ending point for the first gaming effect; and causing, via the electronic processing unit, the second portion of the second gaming effect to be presented via the first output device after the ending point for the first gaming effect.

2. The method of claim 1, wherein the second portion of the second gaming effect follows the first portion of the second gaming effect in a timing sequence for the second gaming effect, and wherein a duration for the first portion of the second gaming effect is substantially equal to a duration of the first gaming effect.

3. The method of claim 1, wherein the determining that the second portion of the second gaming effect is available for presentation via the first output device comprises:

tracking timing of the second gaming effect from a starting point of the first gaming effect as the first gaming effect is presented via the first output device; and determining, at the ending point of the first gaming effect, that the timing of the second gaming effect continues to run.

4. The method of claim 3, wherein the causing the second portion of the second gaming effect to be presented after the ending point for the first gaming effect comprises:

presenting the second gaming effect via the first output device starting from the beginning of the second portion of the second gaming effect, wherein the beginning of the second portion of the second gaming effect coincides with the ending point of the first gaming effect.

5. The method of claim 1 further comprising:

evaluating a first priority value for the first gaming effect against a second priority value of the second gaming effect, wherein the first priority value and the second priority value correspond to the first output device; and determining, based on the evaluating, that the first priority value is greater than the second priority value.

6. The method of claim 1 further comprising:

determining that a second output device of the gaming system is available for presentation of the first portion of the second gaming effect while the first gaming effect is presented via the first output device;

causing the second gaming effect to be presented on the second output device while simultaneously the first gaming effect is presented on the first output device; and after the first gaming effect ends, switching presentation of the second gaming effect from the second output device to the first output device.

7. The method of claim 6, wherein the determining that the second output device of the gaming system is available comprises determining that the first gaming effect does not require presentation on the second output device.

8. The method of claim 6, wherein the second gaming effect is one of a plurality of gaming effects in a presentation queue for the first output device, and further comprising before determining that the second portion of the second gaming effect is available for presentation via the first output device, determining that the second gaming effect has a greater presentation priority than any other gaming effect in the presentation queue.

9. The method of claim 1, wherein the preventing the presentation of the first portion of the second gaming effect comprises:

providing the first gaming effect for presentation via first display elements of the first output device;

providing the second gaming effect for presentation via second display elements of the first output device; and while the first gaming effect is presented via the first display elements, causing the second gaming effect to be transparent via the second display elements, wherein causing the second gaming effect to be transparent causes the first portion of the second gaming effect to not be presented via the first output device while the first gaming effect is presented via the first output device.

10. A gaming system comprising:

at least one electronic processing unit;

one or more output devices;

a network communication interface; and at least one memory storage device configured to store instructions that, when executed by the at least one electronic processing unit, cause the gaming system to perform operations to analyze electronic information received via the network communication interface, wherein the electronic information is associated with a first gaming effect and a second gaming effect provided for concurrent presentation via a first output device of the one or more output devices, determine, based on analysis of the electronic information, that the first gaming effect has a higher priority than the second gaming effect for presentation via the first output device, present the first gaming effect via the first output device before presentation of the second gaming effect based on the higher priority, prevent, without user input, presentation of a first portion of the second gaming effect via the first output device while the first gaming effect is being presented via the first output device, electronically determine that a second portion of the second gaming effect is available for presentation via the first output device after an ending point for the first gaming effect, and present the second portion of the second gaming effect via the first output device after the ending point for the first gaming effect.

11. The gaming system of claim 10, wherein the second portion of the second gaming effect follows the first portion of the second gaming effect in a timing sequence for the second gaming effect, and wherein a duration for the first portion of the second gaming effect is substantially equal to a duration of the first gaming effect.

12. The gaming system of claim 10, wherein the at least one memory storage device is configured to store instructions that, when executed by the at least one electronic processing unit, cause the gaming system to perform operations to:

track timing of the second gaming effect from a starting point of the first gaming effect as the first gaming effect is presented via the first output device; and determine, at the ending point of the first gaming effect, that the timing of the second gaming effect continues to run.

13. The gaming system of claim 12, wherein the at least one memory storage device is configured to store instructions that, when executed by the at least one electronic processing unit, cause the gaming system to perform operations to:

present the second gaming effect via the first output device starting from the beginning of the second portion of the second gaming effect, wherein the beginning of the second portion of the second gaming effect coincides with the ending point of the first gaming effect.

14. The gaming system of claim 10, wherein the at least one memory storage device is configured to store instructions that, when executed by the at least one electronic processing unit, cause the gaming system to perform operations to:

evaluate a first priority value for the first gaming effect against a second priority value of the second gaming effect, wherein the first priority value and the second priority value correspond to the first output device; and determine, based on evaluation of the first priority value against the second priority value, that the first priority value is greater than the second priority value.

15. The gaming system of claim 10, wherein the at least one memory storage device is configured to store instructions that, when executed by the at least one electronic processing unit, cause the gaming system to perform operations to:

determine that a second output device of the one or more output devices is available for presentation of the first portion of the second gaming effect while the first gaming effect is presented via the first output device;

cause the second gaming effect to be presented on the second output device while simultaneously the first gaming effect is presented on the first output device; and after the first gaming effect ends, switch presentation of the second gaming effect from the second output device to the first output device.

16. The gaming system of claim 15, wherein the at least one memory storage device is configured to store instructions that, when executed by the at least one electronic processing unit, cause the gaming system to perform operations to determine that the first gaming effect does not require presentation on the second output device.

17. The gaming system of claim 10, wherein the instructions to prevent presentation of the first portion of the second gaming effect includes instructions that, when executed by the at least one electronic processing unit, cause the gaming system to perform operations to:

cause the second gaming effect to be transparent via the first output device, wherein causing the second gaming effect to be transparent causes the first portion of the second gaming effect to not be presented via the first output device while the first gaming effect is presented.

18. The gaming system of claim 17, wherein the instructions to present the second portion of the second gaming effect via the first output device after the ending point for the first gaming effect includes instructions that, when executed by the at least one electronic processing unit, cause the gaming system to:

cause the second gaming effect to be non-transparent starting from a beginning of the second portion of the second gaming effect, wherein the beginning of the second portion of the second gaming effect coincides with the ending point for the first gaming effect.

19. A non-transitory, machine-readable storage medium having instructions stored thereon, which when executed by a set of one or more electronic processing units of a gaming system cause the gaming system to perform operations comprising:

analyzing electronic information received via a network communication interface of the gaming system, wherein the electronic information is associated with a first lighting effect and a second lighting effect provided for concurrent presentation via an electronic display device associated with the gaming system;

determining, based on analysis of the electronic information, that the first lighting effect has a higher priority than the second lighting effect for presentation via the electronic display device;

in response to the determining that the first lighting effect has the higher priority, causing presentation of the first lighting effect via the electronic display device and, concurrently, causing the second lighting effect to be transparent via the electronic display device, wherein said causing the second lighting effect to be transparent prevents a first portion of the second lighting effect from being presented via the electronic display device while the first lighting effect is presented;

electronically determining that a second portion of the second lighting effect is available for presentation via the electronic display device after an ending point for the first lighting effect;

causing the second lighting effect to be non-transparent at substantially the same time that the first lighting effect reaches the ending point; and presenting the second portion of the second lighting effect via the electronic display device.

20. The non-transitory, machine-readable storage medium of claim 19, wherein the second portion of the second lighting effect follows the first portion of the second lighting effect in a timing sequence for the second lighting effect, and wherein a duration for the first portion of the second lighting effect is substantially equal to a duration of the first lighting effect.

21. The non-transitory, machine-readable storage medium of claim 19, wherein the operations for electronically determining that the second portion of the second lighting effect is available for presentation via the electronic display device includes operations comprising:

tracking timing of the second lighting effect from a starting point of the first lighting effect as the first lighting effect is presented via the electronic display device; and determining, at the ending point of the first lighting effect, that the timing of the second lighting effect continues to run.

22. The non-transitory, machine-readable storage medium of claim 21, wherein the operations for causing the second portion of the second lighting effect to be presented after the ending point for the first lighting effect includes operations comprising:

causing the second lighting effect to be non-transparent starting from a beginning of the second portion of the second lighting effect, wherein the beginning of the second portion of the second lighting effect coincides with the ending point of the first lighting effect.

23. The non-transitory, machine-readable storage medium of claim 19, said operations further comprising:

determining that an additional display device is available for presentation of the first portion of the second lighting effect while the first lighting effect is presented via the electronic display device;

causing the second lighting effect to be presented via the additional display device while simultaneously the first lighting effect is presented via the electronic display device; and after the first lighting effect ends, terminating presentation of the second lighting effect via the additional display device.

24. The non-transitory, machine-readable storage medium of claim 23, said operations further comprising determining that the first lighting effect does not require presentation on the additional display device.

* * * * *